US011186458B2

(12) United States Patent
Adami

(10) Patent No.: US 11,186,458 B2
(45) Date of Patent: Nov. 30, 2021

(54) SPLICING DEVICE FOR WEB MATERIALS, UNWINDER INCLUDING THE SPLICING DEVICE, AND OPERATING METHOD

(71) Applicant: Guangdong Fosber Intelligent Equipment Co., Ltd., Foshan (CN)

(72) Inventor: Mauro Adami, Viareggio (IT)

(73) Assignee: Guangdong Fosber Intelligent Equipment Co., Ltd., Foshan (CN)

( * ) Notice: Subject to any disclaimer, the term of this patent is extended or adjusted under 35 U.S.C. 154(b) by 271 days.

(21) Appl. No.: 16/378,768

(22) Filed: Apr. 9, 2019

(65) Prior Publication Data

US 2019/0233235 A1 Aug. 1, 2019

Related U.S. Application Data

(62) Division of application No. 15/480,668, filed on Apr. 6, 2017, now Pat. No. 10,518,996.

(30) Foreign Application Priority Data

Apr. 11, 2016 (IT) ..... 102016000036888

(51) Int. Cl.

| | |
|---|---|
| ***B65H 19/20*** | (2006.01) |
| ***B65H 19/18*** | (2006.01) |
| ***B65H 21/00*** | (2006.01) |

(52) U.S. Cl.

CPC ..... *B65H 19/20* (2013.01); *B65H 19/18* (2013.01); *B65H 19/1852* (2013.01); *B65H 19/1868* (2013.01); *B65H 21/00* (2013.01); *B65H 2301/41346* (2013.01); *B65H 2301/4641* (2013.01); *B65H 2301/46312* (2013.01); *B65H 2301/46414* (2013.01); *B65H 2402/32* (2013.01); *B65H 2408/2171* (2013.01); *B65H 2408/24153* (2013.01); *B65H 2511/12* (2013.01); *B65H 2701/1762* (2013.01)

(58) Field of Classification Search

CPC .... B65H 19/18; B65H 19/20; B65H 19/1852; B65H 19/1868; B65H 21/00

See application file for complete search history.

(56) References Cited

U.S. PATENT DOCUMENTS

| | | | | |
|---|---|---|---|---|
| 4,919,353 | A | 4/1990 | Isowa et al. | |
| 5,487,805 | A | 1/1996 | Boriani et al. | |
| 7,441,579 | B2 | 10/2008 | Adami | |
| 2004/0084133 | A1 | 5/2004 | Adami | |
| 2005/0279461 | A1 * | 12/2005 | Adami | B65H 19/1863 156/502 |

FOREIGN PATENT DOCUMENTS

| | | | |
|---|---|---|---|
| EP | 1609749 | A1 | 12/2005 |
| JP | 58144039 | A | 8/1983 |

* cited by examiner

*Primary Examiner* — Sang K Kim

(74) *Attorney, Agent, or Firm* — Breiner & Breiner, L.L.C.

(57) ABSTRACT

The splicing device for splicing a trailing edge of a first web material to a leading edge of a second web material includes members defining a feed path of the web material. The device also includes a first cutting member and a second cutting member, cooperating with the first cutting member. One of the two cutting members is provided with a movement transverse to the feed path of the web material, to move the cutting member from an operating position, in which it is in front of the other cutting member, to an idle position, withdrawn with respect to the feed path of the web material.

2 Claims, 21 Drawing Sheets

SPLICING DEVICE FOR WEB MATERIALS, UNWINDER INCLUDING THE SPLICING DEVICE, AND OPERATING METHOD

RELATED APPLICATION

This is a division of U.S. Ser. No. 15/480,668 filed Apr. 6, 2017, which is incorporated herein in its entirety by reference.

FIELD OF INVENTION

The present invention relates to machines and devices for converting continuous web materials, such as, but not only, webs or strips of paper for producing corrugated board.

More in particular, embodiments described herein relate to improvements to splicing devices (splicers) for splicing the leading edge of a web material standing by to the trailing edge of an expiring web material dispensed from a roll being unwound.

Embodiments described herein also relate to machines or devices for unwinding rolls of web material (unwinders) equipped with a splicing device.

BACKGROUND OF THE INVENTION

In many industrial fields it is necessary to continuously process sheets or webs of material unwound from a roll. Typically, in the corrugated board sector, unwinders with a plurality of means for supporting and unwinding rolls of web material, typically flat paper, are commonly used to produce corrugated board boxes or other articles. A plurality of corrugated board webs is fed to single facers and to double facers for the production of multi-layer corrugated board.

The unwinder comprises a splicing device (hereinafter also splicer) that makes the splice, i.e., the connection of the trailing edge of an expiring web material from a first roll being processed to the leading edge of a second web material of a second roll standing by. By automatically or semi-automatically splicing the leading edge and trailing edge of the two web materials, it is possible to operate the unwinder, and consequently the line containing it, in a substantially continuous manner.

In some cases, such as typically in the field of corrugated board manufacturing, it is preferable for the trailing edge and the leading edge of the two web materials to be spliced in close proximity of their respective free ends, to prevent problems in the subsequent processing steps. This requires particular measures to be taken to provide the device that carries out splicing, and sets some limits to the way in which the rolls of web material can be supported and unwound.

Modern unwinders and splicing devices for these purposes are described, for example, in EP 1609749 and in US 2004/0084133, the content of which is incorporated herein by reference.

When there is sufficient space on the two sides of the processing line, the rolls of web material are inserted from one side of the processing line and the empty cores are removed from the opposite side of the processing line. This is not possible in some plant layouts, for example as there is insufficient space on both sides of the processing line. This typically occurs when there is an obstacle, such as a wall, another processing line, or other obstacles on one of the sides of the processing line. Therefore, unwinders with three positions, which allow insertion and removal of the rolls from the same side of the line, have been developed.

Exemplary embodiments of unwinders and processing plants of this kind are described in U.S. Pat. No. 7,441,579 and in U.S. Pat. No. 4,919,353, as well as in the two publications cited above (EP 1609749 and US 2004/0084133 A1).

The use of unwinders with three stations of this kind has some drawbacks. For example, their overall dimensions are relevant and this has a negative impact on the total length of the processing line. Moreover, unwinders of this type are complex and costly.

Therefore, there is the need to provide an automatic or semi-automatic unwinding and splicing system of web materials coming sequentially from rolls being processed to feed a processing line in a continuous manner, which entirely or partially overcomes the drawbacks of the prior art.

SUMMARY OF INVENTION

According to a first aspect, a splicing device, i.e., a splicer, is provided for splicing a trailing edge of a first web material to a leading edge of a second web material, comprising: members defining a feed path of the web material; a first cutting member; and a second cutting member, co-acting with the first cutting member. According to embodiments described herein, at least one of said first cutting member and second cutting member is provided with a movement transverse to the feed path of the web material, to move the cutting member from an operating position, in front of the other cutting member, to an idle position, removed from the feed path of the web material.

In practice, the web material has a feed direction, or machine direction, and a transverse direction, orthogonal to the machine direction. The feed path extends in machine direction and has a width in transverse direction. The first or the second cutting member can be withdrawn with respect to the feed path in a direction that can be substantially orthogonal to the machine direction and substantially parallel to the transverse direction. Therefore, in practice the cutting member provided with the withdrawal movement moves on a plane having a distance with respect to the feed path that remains substantially the same. Therefore, the withdrawal movement can be substantially orthogonal to the movement with which the first cutting member and the second cutting member move toward and away from each other to perform cutting of the web material.

For example, the first cutting member can be a blade and the second cutting member can be a counter blade. The blade or the counter blade can be provided with a withdrawal movement with respect to the feed path, to be carried in front of the other cutting member.

The first cutting member, the second cutting member, or both, can then be provided with a movement toward and away from each other substantially transverse both to the machine direction and to the transverse direction of the web material, to move toward and co-act with each other in the action of cutting the web material. In other words, one of the two cutting members can be provided with a cutting movement and the other can be without the cutting movement. The description below illustrates a splicing device in which a first cutting member is provided, with respect to a fixed load-bearing structure, with the cutting movement, i.e., toward and away from the second cutting member, to cut the web material located between the two cutting members. Vice versa, the second cutting member is provided, with respect to the load-bearing structure, only with the withdrawal movement, but not with the cutting movement. In other words, it moves parallel to itself and to the transverse direction, to be positioned in front of the first cutting member and to withdraw laterally with respect to it and with respect to the feed path.

However, in other embodiments it would also be possible for one of the two cutting members to be completely stationary and the other to be provided both with the cutting movement and with the withdrawal movement, or for both the cutting members to be provided with a movement toward and away from each other with respect to a fixed load-bearing structure.

In substance, while in prior art splicing devices the two cutting members are movable to approach one another and co-act with each other, to cut the web material that passes between them, and to then move away from each other remaining opposite each other, i.e., one in front of the other, according to the present disclosure the first and the second cutting member have a further mutual movement, whereby they move selectively to a first active position, in which they are one in front of the other to cut the web material that passes between them, and to an idle position, in which they are staggered transversely, with the web material that can pass in front of one of the two cutting members, while the other is withdrawn, i.e., positioned at the side of the feed path.

As will be apparent from the description below, in this way it is possible to perform splicing of two web materials coming from two rolls carried by a same rotating structure, using a single splicing device and using two co-acting members, to obtain a correct and clean cut. When the leading edge of a second web material coming from a second roll has been spliced to a trailing edge of a first web material coming from a first roll, generated by cutting the first web material, and the web material is fed along a path that is outside the pair of cutting members, it is possible to withdraw one of the two cutting members to modify the path of the second web material and return the cutting member, which was withdrawn, to an inserted position, in front of the other cutting member, with the path of the second web material positioned between the first cutting member and the second cutting member.

The members defining the feed path of the web material can comprise a first guide roller, movable between a first position and a second position, in the first position the path of the web material passing adjacent to the first cutting member and to the second cutting member, when said first cutting member and second cutting member are placed one in front of the other, and in the second position the path of the web material being at a distance from the cutting members. This facilitates withdrawal of the cutting member that is to be taken temporarily to the idle position.

The members defining the feed path of the web material can comprise a second guide roller, substantially parallel to the first guide roller. The first guide roller and the second guide roller can define a portion of path of the web material, which passes between the first cutting member and the second cutting member when the first guide roller is in said first position and the first cutting member and the second cutting member are positioned one in front of the other.

The withdrawable cutting member, i.e., the one provided with a movement transverse to the feed path of the web material, can be integral with a third guide roller, movable integral with the withdrawable cutting member in the movement transverse to the feed path of the web material.

In some embodiments, the splicing device can comprise a leading edge retaining device for retaining the leading edge of the second web material in a standby position. For example, the leading edge retaining device for retaining the leading edge of the second web material comprises an anvil surface and a pinching member co-acting with the anvil surface, arranged and configured to pinch and retain the leading edge of the web material between the anvil surface and the pinching member.

The retaining device can be configured and arranged to hold the leading edge of the second web material standing by outside the feed path of the first web material, which passes between the first cutting member and the second cutting member. The retaining position can be adjacent to the feed path of the first web material. After cutting of the first web material and splicing of the trailing edge of the first web material, generated the cut, with the leading edge of the second web material standing by, the feed path of the second web material is positioned temporarily outside the space defined between the first cutting member and the second cutting member. To return the path of the web material between the first cutting member and the second cutting member, so as to be able to perform the subsequent cut, one of the two cutting members is withdrawn laterally and the second web material is moved toward the cutting member that has remained stationary, i.e., that has not been withdrawn. After this movement has been carried out, the cutting member that was withdrawn can be returned to the active position, in front of the other cutting member, with the second web material passing between the two cutting members.

In some embodiments, the anvil surface is integral with the cutting member provided with the withdrawal movement, transverse to the feed path of the web material, and is movable therewith in the movement transverse to the feed path of the web material.

In some embodiments the pinching member is provided with a movement toward or away from the anvil surface, is arranged in a position aligned transverse to the feed path of the web material and does not need to participate in the withdrawal movement.

The splicing device can also comprise pressing members to press the leading edge of the second web material against the trailing edge of the first web material. These pressing members can comprise the pinching member.

The splicing device can also comprise a braking member arranged to co-act with a braking surface. One, the other, or both said elements can be movable to pinch and brake the first web material therebetween before cutting. At least one of the elements, for example the braking surface, can withdraw transversely to the feed path together with the cutting member that is provided with the withdrawal movement.

In some embodiments, one of the cutting members, for example the one not provided with the withdrawal movement, can be carried by pivoting side members, which also support a pressure roller or another pressure member that, in the step subsequent to cutting the first web material, applies a pressure between the trailing edge of the first web material and the leading edge of the second web material, as a result of which splicing is obtained by mutual gluing of the leading edge of the second web material to the trailing edge of the first web material. The pressure can be exerted against a retaining member, such as a roller, which temporarily retains the leading edge of the second web material adjacent to the cutting area, i.e., close to the first and/or to the second cutting member.

According to a further aspect, an unwinder for unwinding rolls of web materials is provided, comprising an assembly rotating about a substantially horizontal rotation axis, having a first seat for a first roll of web material and a second seat for a second roll of web material, in the first seat and in the second seat the rolls of web material being supported with their axes substantially parallel to the rotation axis of the rotating assembly. Moreover, the unwinder comprises a splicing device as defined above.

According to yet another aspect, a method for splicing a trailing edge of a first web material to a leading edge of a second web material is provided, comprising the following steps:

- feeding the first web material along a feed path;
- arranging a first cutting member on a first side of the feed path and a second cutting member on a second side of the feed path, and one in front of the other;
- arranging and retaining the leading edge of the second web material in proximity of the feed path, adjacent to one of said first cutting member and second cutting member;
- cutting the first web material thus generating the trailing edge of the first web material and splicing the trailing edge of the first web material to the leading edge of the second web material;
- moving one of said first cutting member and second cutting member transverse to the feed path and withdrawing said cutting member from the feed path;
- moving the second web material toward the other of said first cutting member and second cutting member;
- returning the first cutting member and the second cutting member one in front of the other with the second web material arranged therebetween and feeding the second web material along the feed path between the first cutting member and the second cutting member.

In some embodiments, the leading edge of the second web material is provided with an adhesive material, for example a double-sided adhesive tape, arranged to glue the leading edge of the second web material to the trailing edge of the first web material.

Splicing can be facilitated by mutual pressure members. In some embodiments, the method can comprise the step of retaining the leading edge of the second web material in a standby position by pinching the second web material between an anvil surface and a pinching member, for example a roller. In some embodiments, the method can also comprise the step of pressing the leading edge of the second web material against the trailing edge of the first web material by means of the aforesaid pinching member and a second pressure member, for example a second roller.

BRIEF DESCRIPTION OF THE DRAWINGS

A better understanding of the invention and of its many advantages will be obtained from the following description of some embodiments, with reference to the accompanying drawings, wherein:

FIGS. 6A-21A illustrate in an enlargement the operating sequence of the splicing device of the unwinder in the moments corresponding to the operating steps illustrated in FIGS. 6 to 21.

DETAILED DESCRIPTION OF EMBODIMENTS

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 1:
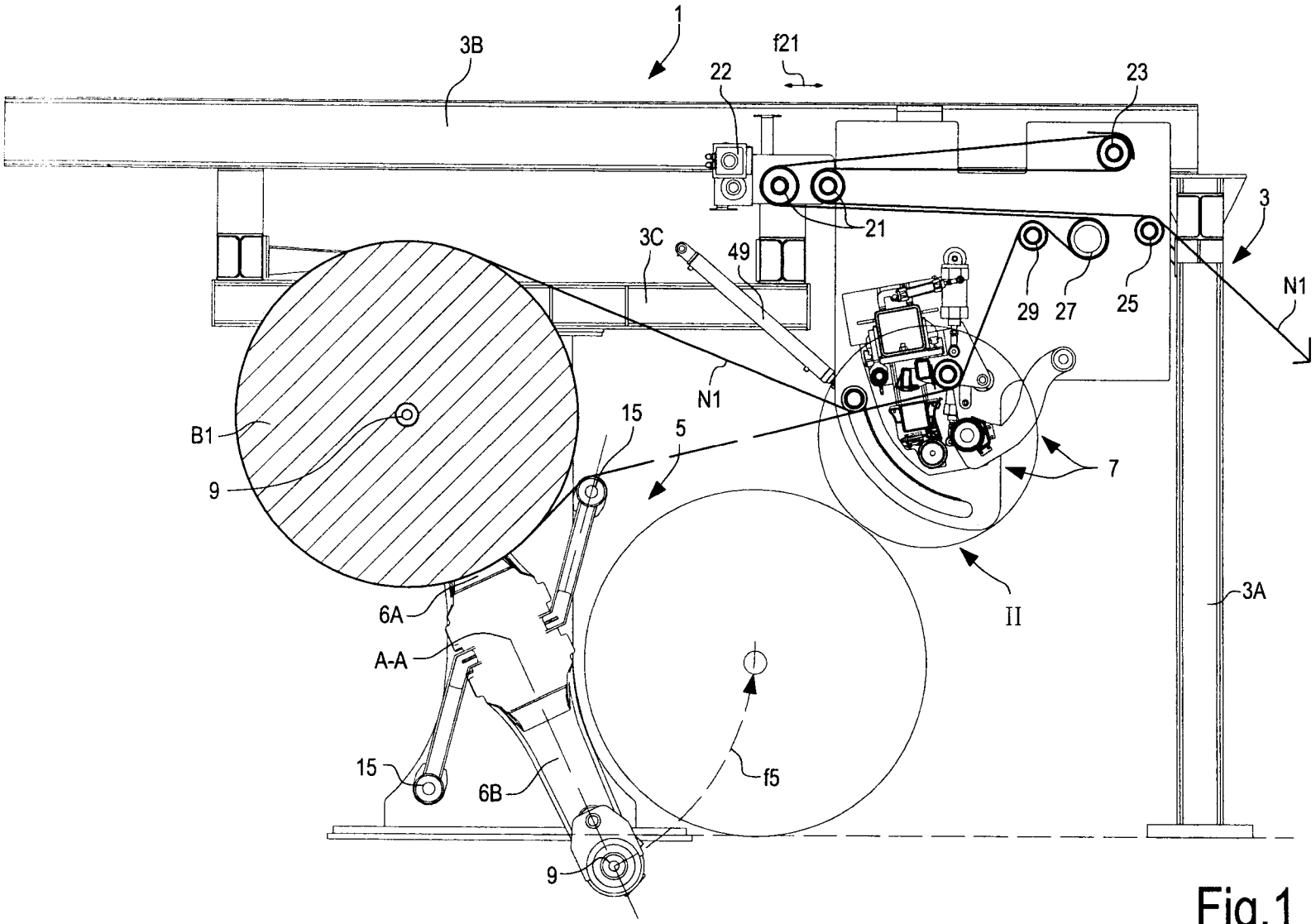
FIG. 1 illustrates a side view of an unwinder for unwinding rolls of web material according to the present disclosure.

With initial reference to FIG. 1, reference number 1 indicates as a whole an unwinder for rolls of web material, for example paper rolls. The unwinder can be part of a corrugated board production line that comprises: a plurality of unwinders, one or more single facers, which receive at the inlet two webs of flat paper and produce a composite web formed of a web of flat paper glued to a web of fluted paper; a series of double facers that glue composite webs coming from one or more single facers to each other and to a web of flat paper. The line typically also comprises an end section in which the composite web material, formed by a plurality of sheets of flat and fluted paper alternated with one another, is creased and cut longitudinally and then transversely to obtain single sheets for the production of cardboard boxes or the like.

In the embodiment illustrated, the unwinder 1 comprises a load-bearing structure 3, a rotating assembly 5 for supporting two rolls of web material, one being processed and the other standing by; and a splicing device 7 (also known as splicer), which performs splicing of the trailing edge of a web material coming from a first roll being unwound to the leading edge of the web material coming from a second roll standing by.

The splicing operation of two web materials can be performed, for example, when the first roll, from which the first web material comes, is about to expire and has to be replaced with a new roll. However, there are also other situations in which it may be necessary to perform a splicing cycle between a first web material coming from a first roll being processed and the leading edge of a second web material coming from a roll standing by. This occurs, for example, when switching from the production of one type of corrugated board to another type of corrugated board, which requires the use of a web material of different composition, thickness, width or other features.

Figure 3:
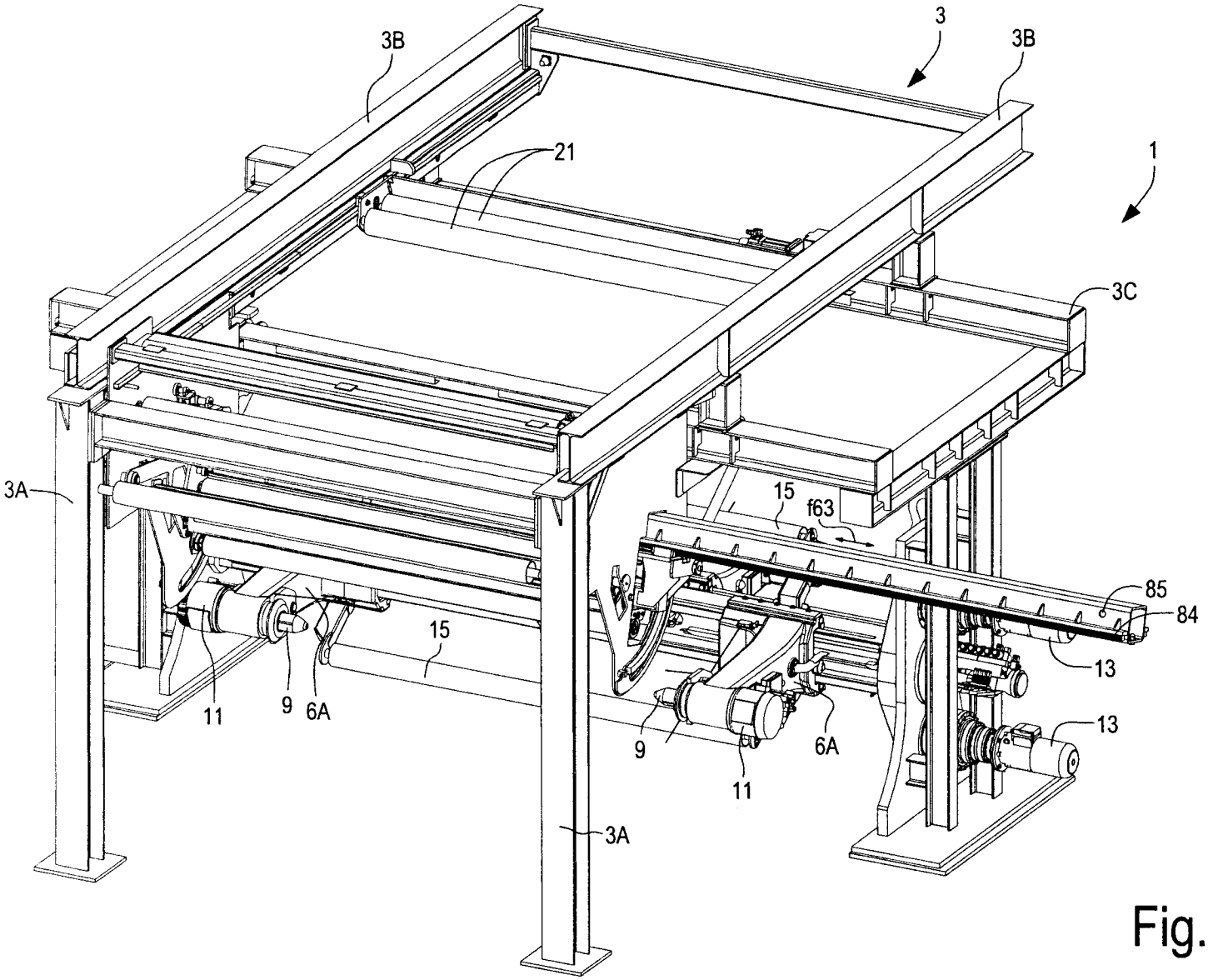
FIGS. 3 and 4 illustrate axonometric views of the unwinder and of the related splicing device of FIGS. 1 and 2 with the splicing device in two distinct operating positions.
Figure 4:
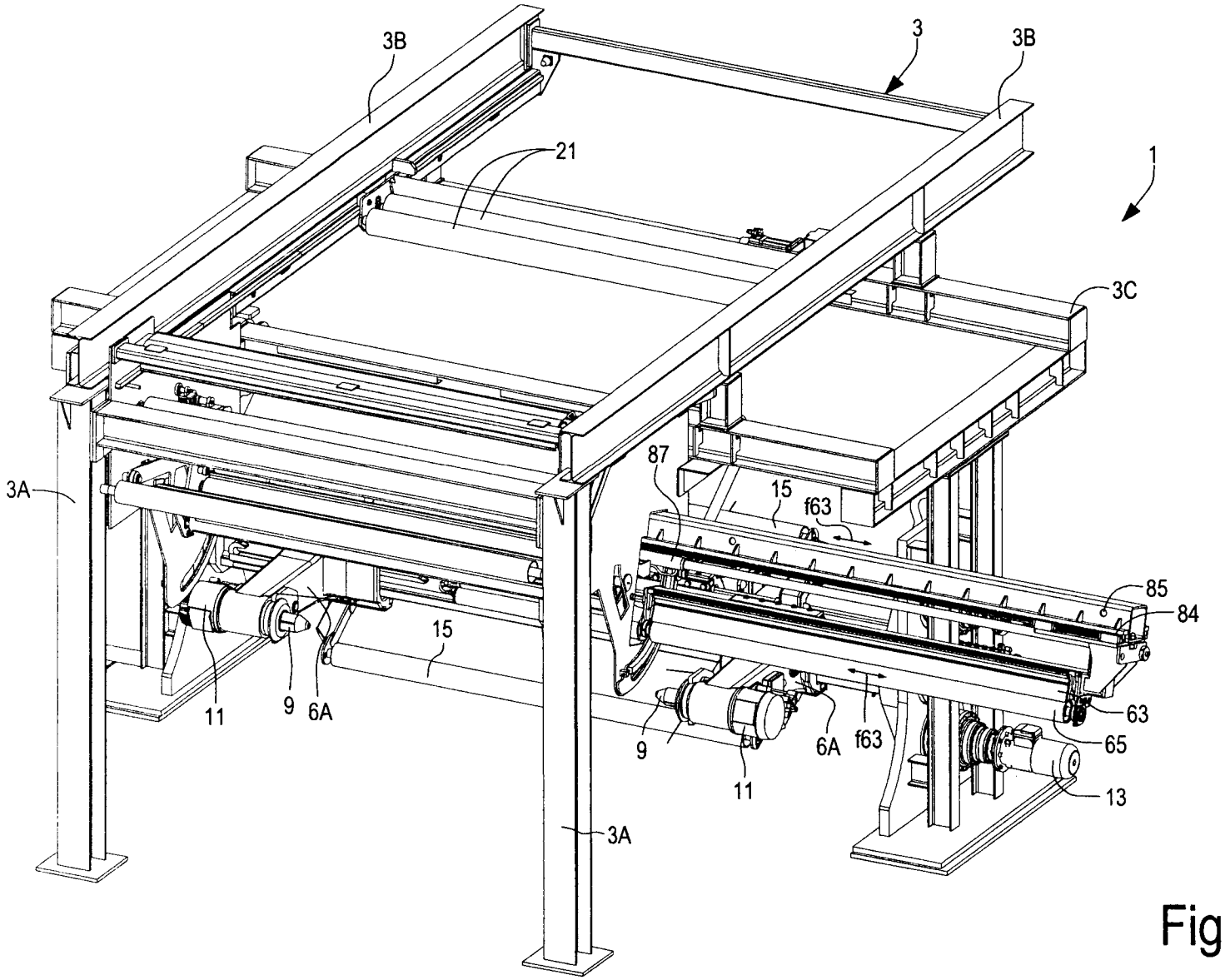

The rotating assembly 5 can comprise two pairs of arms 6A and 6B, one of which (the pair of arms 6A) is visible in particular in FIGS. 3 and 4.

Each arm 6A, 6B can support a tailstock 9, configured to engage an end of a respective roll of wound web material, for example paper.

The tailstocks 9, coaxial to each other, can be provided with an extraction and retraction movement parallel to their axis and can be provided with brakes 11 that control unwinding of the respective roll of web material, which is normally unwound by traction. The brakes 11 allow the web material being unwound to be maintained suitably tensioned.

The rotating assembly 5 is provided with a rotation movement according to the arrow f5 (FIG. 1) about a rotation axis A-A that can be substantially horizontal. The rotation about rotation axis A-A according to arrow f5 can be controlled by a pair of motors 13 (FIGS. 3 and 4) that can operate in tandem, for example acting through two respective gear wheels on the central ring gear coaxial to the rotating assembly 5, i.e., having an axis coinciding with the rotation axis A-A. The gear wheels and the central ring gear are not shown.

Moreover, the rotating assembly 5 can comprise a pair of guide rollers 15 to guide the web material correctly during the various steps of the operating cycle, as will be explained in more detail below with reference to the sequence of FIGS. 6 to 21.

The load-bearing structure 3 can have a pair of uprights 3A and a pair of cross members 3B. The cross members 3B, as well as by the uprights 3A, can be supported by a frame 3C (see in particular FIGS. 3 and 4), to which the rotating assembly 5 is constrained.

The cross members 3B can support guide rollers 21, 23, 25, 27, 29 for the web material being fed. The rollers 21 can be provided with a movement according to arrow f21 along the cross members 3B to increase or decrease a supply of web material forming a festoon along the load-bearing structure 3 and/or to adjust the tension of the web material, in the manner that will be described later on. Reference number 22 indicates a gear motor that controls the movement according to f21 of the pair of rollers. The movement can be obtained with a pinion rotated by the gear motor 22, which meshes with a rack fixed to one of the cross members 3B.

The splicing device 7 is illustrated in particular in FIGS. 2 to 5. In some embodiments, the splicing device 7 comprises a first guide roller 41 and a second guide roller 43, at a distance from each other to define a portion of a path of a web material N1 that can advance according to the arrow fN.

Figure 2:
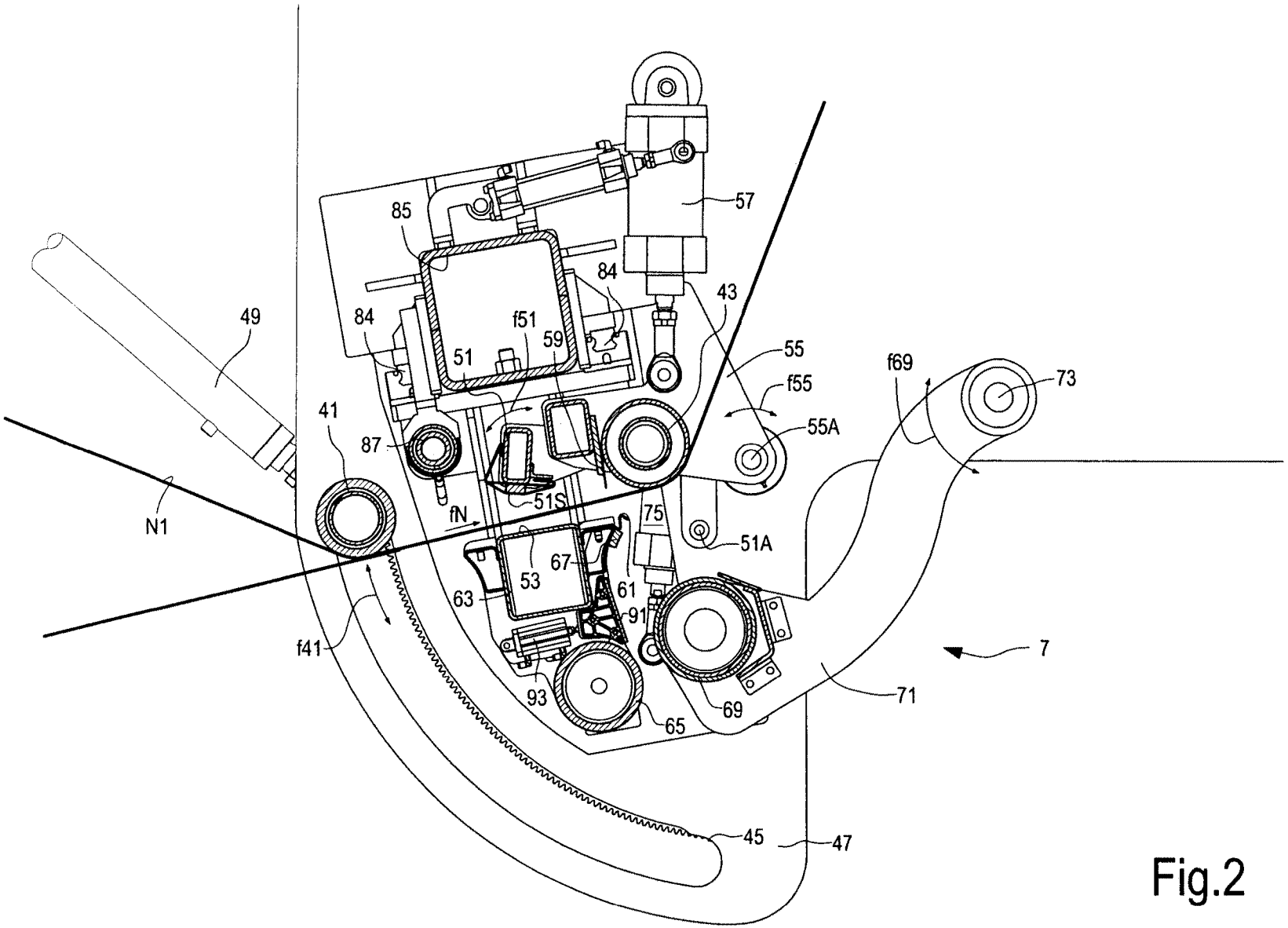
FIG. 2 illustrates an enlargement of the detail II of FIG. 1.

The first guide roller 41 is movable along a trajectory in the form of an arc of circumference according to double arrow f41, to take a first position represented in FIG. 2 and a second position, in which the roller 41 can be at the opposite end of a pair of slots 45 provided in a pair of side members 47 integral with the structure 3. A piston-cylinder actuator 49 can be provided to supply the movement according to the double arrow f41 to the first guide roller 41.

A braking member 51 provided with a pivoting movement about a fulcrum 51A can be positioned above the path of the web material N1 that extends between the first guide roller 41 and the second guide roller 43. The reciprocating pivoting movement according to double arrow f51 can be controlled by a piston-cylinder actuator, by an electric motor, by a hydraulic motor or by another suitable actuator, not shown in FIG. 2.

The braking member 51 can have a surface 51S adapted to co-act with a braking surface 53 below, positioned with respect to the braking member 51 so that the path of web material between the first guide roller 41 and the second guide roller 43 passes between the surface 51S of the braking member 51 and the braking surface 53.

The second guide roller 43 can be carried by a side member or by a pair of side members 55 pivoting about an axis 55A as indicated by double arrow f55. The pivoting movement of the side members 55 can be controlled by a piston-cylinder actuator 57. It would also be possible to use other types of actuators to control the movement f55, such as a rotary or linear electric motor, or a rotary or linear hydraulic motor. In addition to the guide roller 43, the side members 55 carry a first cutting member 59, hereinafter indicated as "blade". The blade 59 can co-act with a second cutting member 61, hereinafter named "counter blade". The counter blade 61 can be configured as a channel, inside which the blade 59 can penetrate. It would also be possible to reverse the arrangement of the cutting members 59, 61, positioning a blade in place of the cutting member 61 and a counter blade in place of the cutting member 59.

The blade 59 and the counter blade 61 are arranged on opposite sides of the feed path of the web material N1 defined between the guide rollers 41, 43 in the arrangement of FIG. 2. The movement f55 of the side members 55 controlled by the piston-cylinder actuator 57 causes both the movement of the second guide roller 43, and the lowering movement of the blade 59 to co-act with the counter blade 61 arranged therebelow.

The counter blade 61 is carried by a beam 63 that also forms the braking surface 53. The beam 63 carries a third guide roller 65, with an axis substantially parallel to the axes of the first guide roller 41 and of the second guide roller 43. As will be clarified below, the beam 63 with all the members connected thereto and supported thereby, such as in particular the third guide roller 65 and the counter blade 61, can withdraw with respect to the feed path of the web material N1 in a direction transverse to the feed path, i.e., in a direction orthogonal to the plane of FIG. 2, for the purposes that will be explained later on.

The splicing device 7 can further comprise a retaining device for retaining the leading edge of a second web material coming from a second roll standing by, the leading edge which is to be spliced to the trailing edge of the first web material N1 being unwound from a first roll B1 located in the unwinder 1.

In the embodiment illustrated, the retaining device for retaining the leading edge of web material comprises an anvil surface 67 and a pinching member 69, cooperating with each other. As will be more apparent below with reference to the sequence of FIGS. 6 to 21, the pinching member 69 is pressed against the anvil surface 67, thus retaining the leading edge of web material between the pinching member 69 and the anvil surface 67.

In the embodiment illustrated the pinching member 69 comprises a roller carried by a pair of arms 71 pivoted at 73 to the load bearing structure 3. Reference number 75 indicates a piston-cylinder actuator that can control the pivoting movement according to double arrow f69 of the roller 69 about the fulcrum 73. The anvil surface 67 is integral with the beam 63 and is therefore moved transverse to the feed path of the web material N1 according to a direction orthogonal to the plane of FIG. 2 together with the beam 63, while the pinching member formed by the roller 69 remains in front of the path of the web material N1 defined by the guide rollers 41 and 43. As will be apparent from the description of the operating sequence of FIGS. 6 to 21 and of FIGS. 6A to 21A, during an operating cycle of the splicing device, the roller 69 forming the pinching member also co-acts with the second guide roller 43. The two rollers 69 and 43 form a pressure system to splice the leading edge of the web material coming from a roll standing by to the trailing edge of the web material coming from the roll being unwound.

Figure 5:
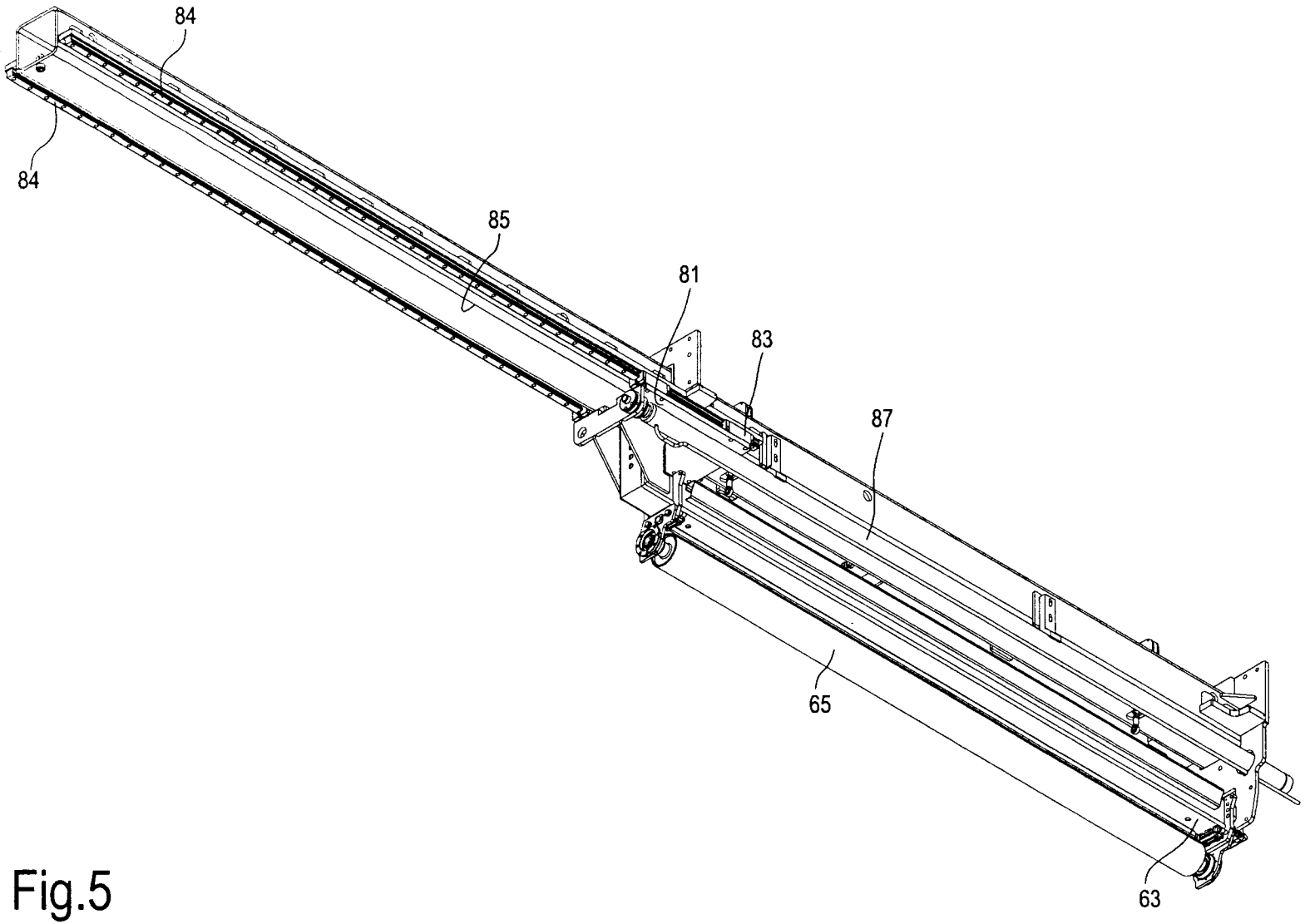
FIG. 5 illustrates a detail of the moving part of the splicing device of FIGS. 3 and 4.

The insertion and extraction movement of the beam 63 with respect to the feed path of the web material N1 is more clearly shown in FIGS. 3 and 4, while FIG. 5 illustrates in detail the device that allows the extraction and insertion movement of the beam 63 with respect to the load bearing structure 3.

In some embodiments, the beam 63 is supported by a slide 81 that engages, for example by means of shoes 83, a guide 84 integral with a cross member 85 that extends approximately orthogonal to the feed path of the web material N1 and that projects laterally with respect to the load bearing structure 3 of the unwinder 1, as is shown in particular in FIGS. 3 and 4. The extraction and insertion movement of the beam 63 guided along the guides 84, can be controlled by a piston-cylinder actuator 87, shown in particular in FIG. 5 and in the enlargement of FIG. 2.

In FIGS. 3 and 4 the extraction and insertion movement of the beam 63 with respect to the load bearing structure 3 is indicated with the double arrow f63.

In the position of FIG. 3 the beam 63 is inserted inside the structure 3 of the unwinder 1 so that the counter blade 61, the anvil surface 67 and the third guide roller 65 are arranged aligned with the path of the web material N, i.e., in front of and below this path. In substance, in this position the counter blade 61 is opposite the blade 59; the web material N1 fed along the feed path passes between the blade 59 and the counter blade 61. Being opposite each other, the blade 59 and the counter blade 61 can be moved one against the other thus cutting the web material that passes therebetween, in order to form the trailing edge of the web material fed from the first roll.

Having described the main members of the unwinder 1 and of the splicing device 7, with reference to the sequence of FIGS. 6 to 21 and 6A to 21A, the splicing cycle of the trailing edge of a first web material N1 unwound from a first roll B1 to the leading edge of a second web material N2 from a second roll B2 will now be described in detail.

Figure 6A:
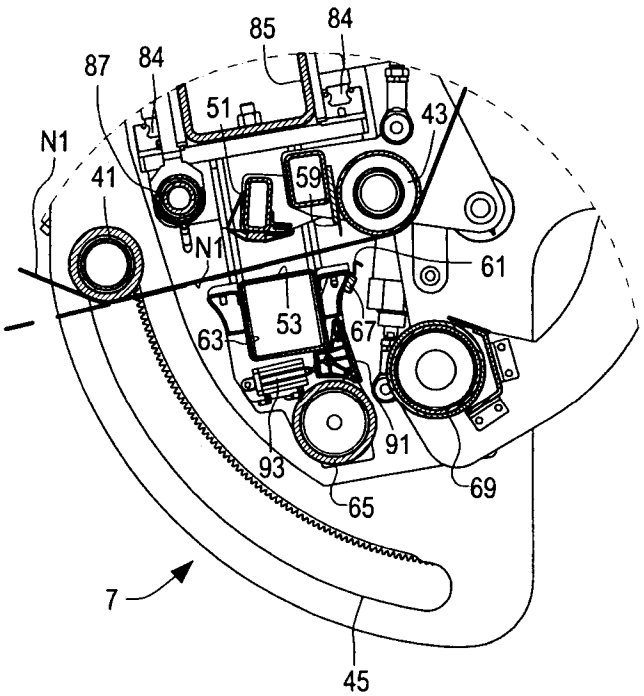
Figure 6:
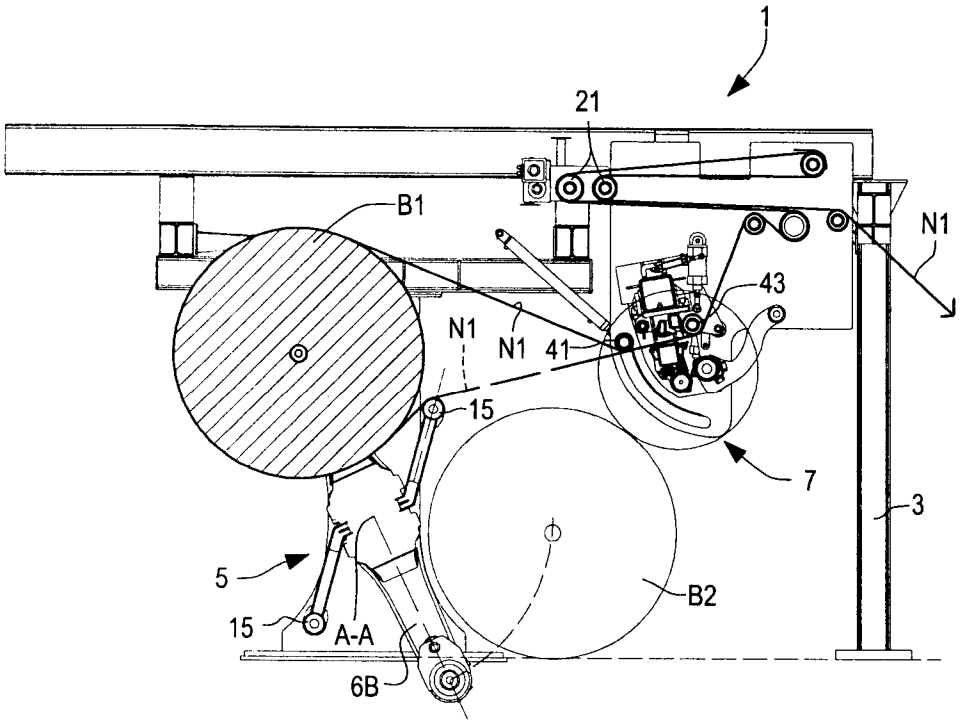
FIGS. 6 to 21 illustrate an operating sequence of the unwinder of FIG. 1.

FIG. 6 shows a step of operation of the unwinder 1, in which the first roll B1 is in operating position supported by the pair of arms 6A of the rotating assembly 5. The web material N1 can be wound clockwise or counter-clockwise on the roll B1 and can thus advance according to one or the other of the two paths depicted respectively with a continuous line and with a dashed line and labeled N1. In the path depicted with the dashed line the web material N1 is guided around the guide roller 15.

The feed path of the web material N1 has a substantially rectilinear segment between the first guide roller 41 and the second guide roller 43 of the splicing device 7. In this step, the splicing device 7 is idle. In FIG. 6, the position to be taken by a second roll B2 of web material, which will replace the first roll B1 from which the web material N1 is being unwound, is depicted with a dashed line.

As mentioned, replacement of the roll B1 with a roll B2 can be necessary when the web material N1 has expired, or when the web material N1 must be replaced with a material N2 different from the web material N1.

As can be seen in particular in FIG. 6A, in this step the roller forming the pinching member 69 is in a low position, at a distance from the anvil surface 67. This latter, together with the third guide roller 65 and with the counter blade 61, is in a position inside the unwinder 1, so that the counter blade 61 is opposite the blade 59, with the web material N1 passing between said two cutting members.

The braking member 51 is distanced from the braking surface 53 and in front of it, with the web material N1 passing between them. The first guide roller 41 is in the upper position, i.e., at the upper end of the slot 45.

Figure 7A:
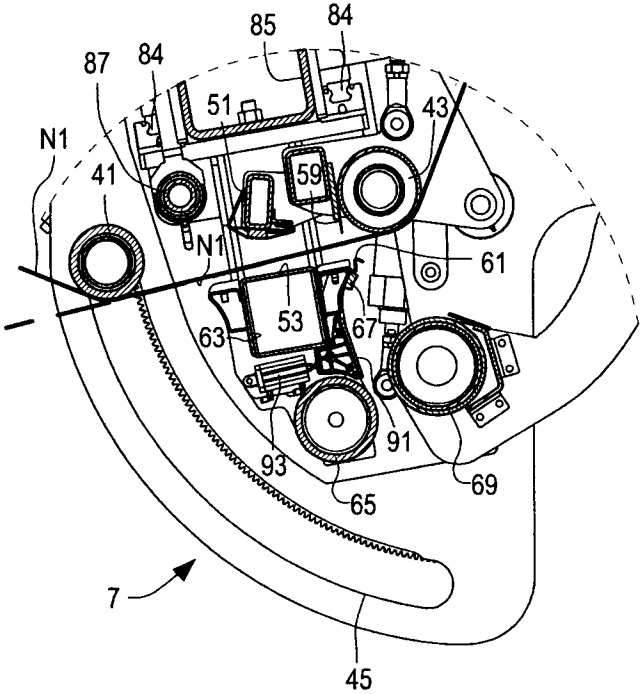
Figure 7:
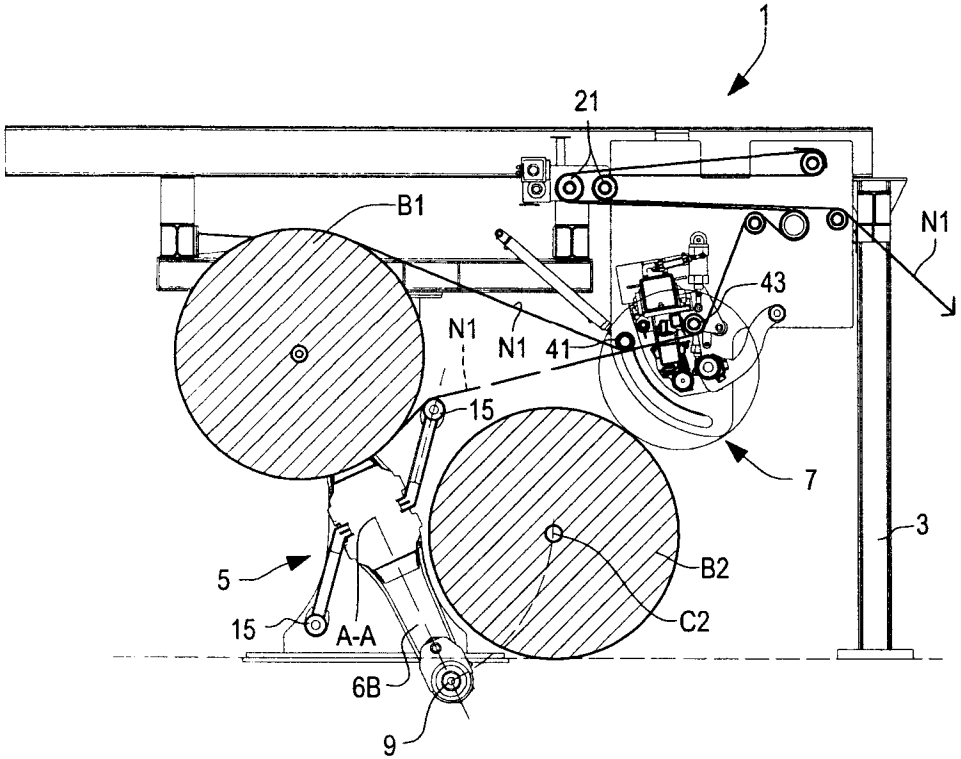

FIG. 7 illustrates the subsequent step, in which the second roll B2 of web material has been inserted into the unwinder 1, i.e., has been carried inside the load bearing structure 3, aligned with the arms 6A, 6B. As can be seen in FIG. 7A, the positions of the members of the splicing device 7 remain unchanged.

It must be understood that the movements of the various members can also differ with respect to the sequence described, provided that it is still possible to correctly perform the operations described below. For example, in the step of FIG. 6A, the beam 63 could be outside the load bearing structure, i.e., in the position of FIG. 4. In fact, as can be understood by comparing FIGS. 6A and 7A, in this part of the operating cycle the splicer 7 is idle and can be in any position.

Figure 8A:
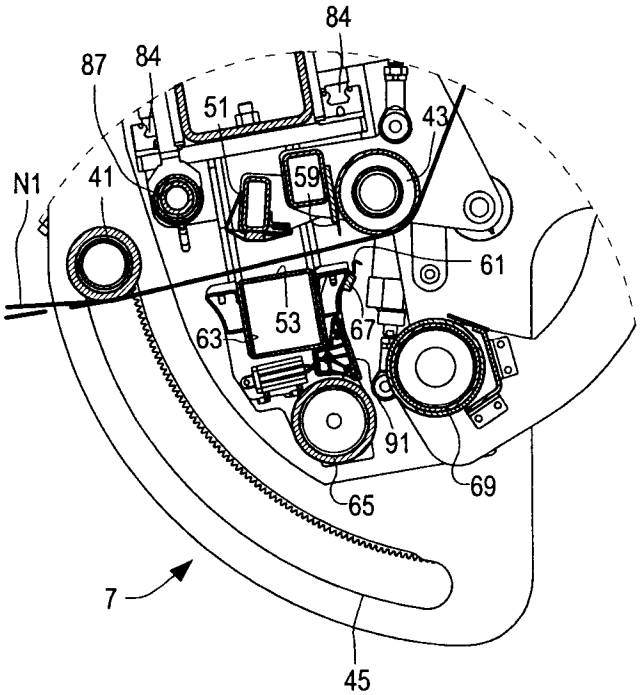
Figure 8:
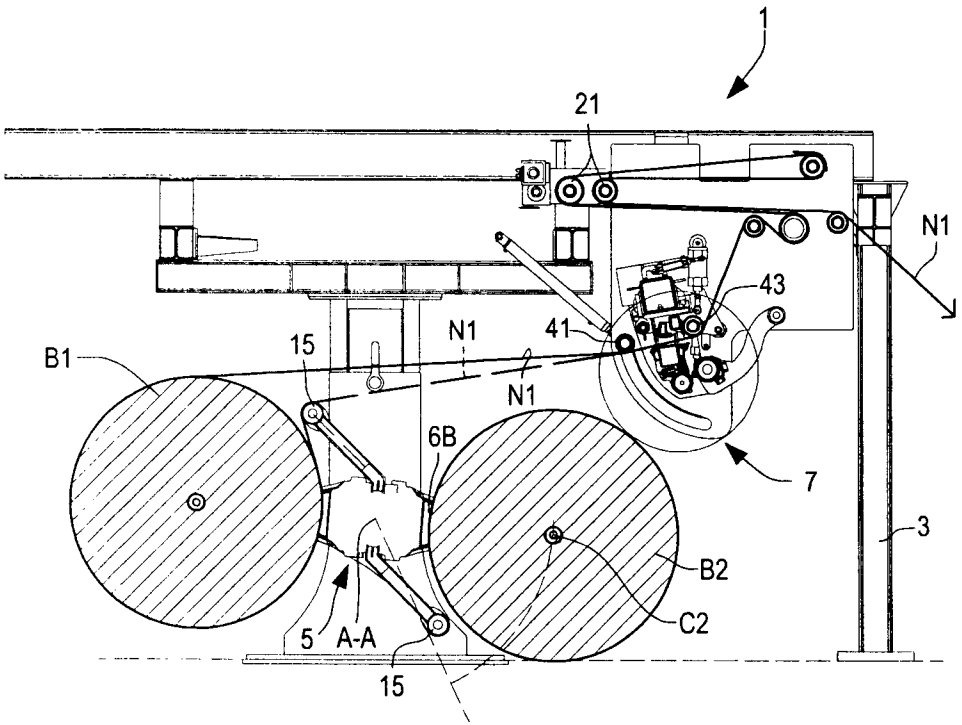

The next FIG. 8 illustrates the step in which the rotating assembly 5 has performed a rotation of approximately 60° to carry the tailstocks 9 of the arms 6B in axial alignment with the center C2 of the roll B2. In this position the tailstocks 9 can be moved toward each other to engage with a tubular core or a mandrel on which the roll B2 is formed. The members of the splicing device 7 remain in the position illustrated in FIGS. 6A and 7A, or in another position, for example with the beam 63 extracted.

Figure 9A:
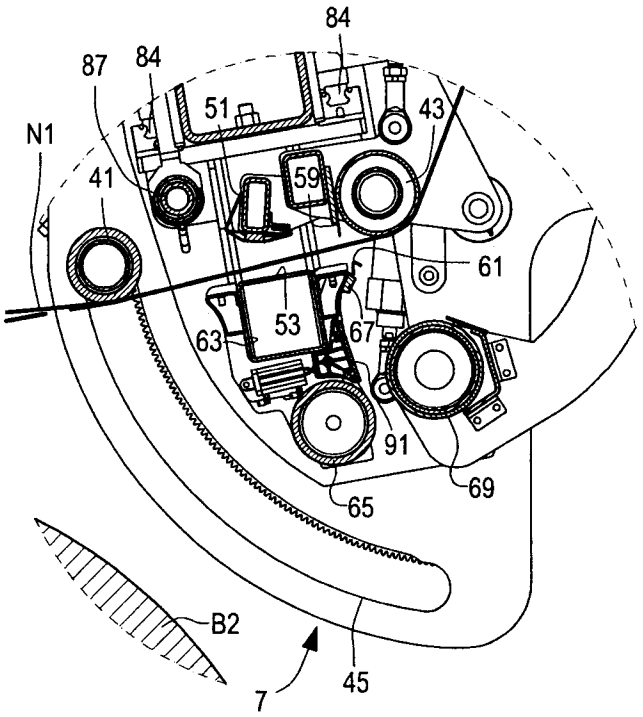
Figure 9:
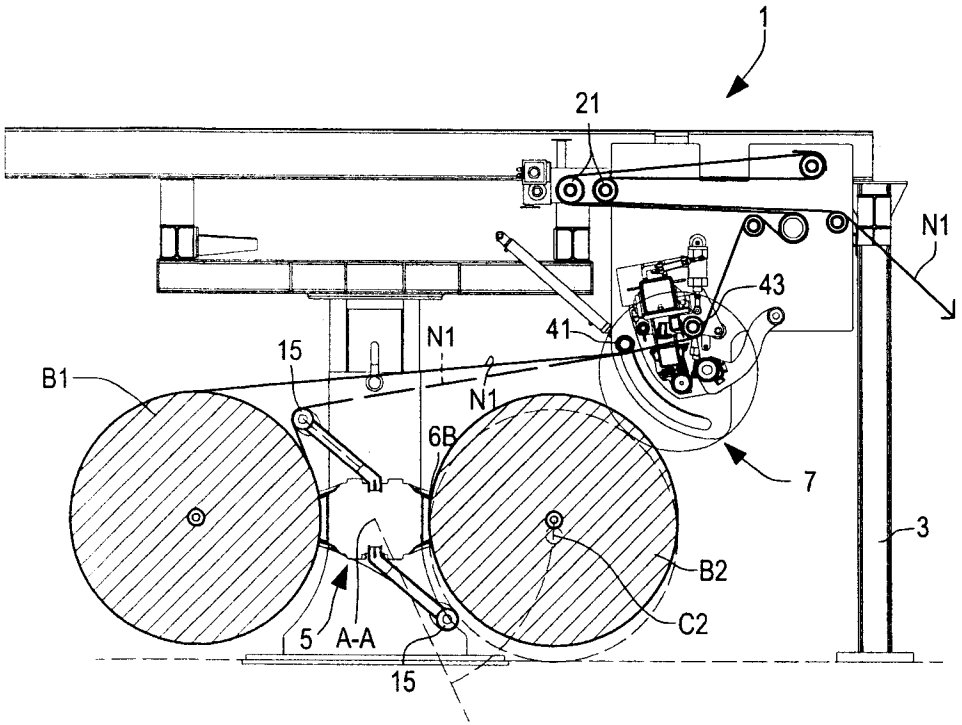

In the subsequent FIG. 9, the rotating assembly 5 has performed a further rotation (counter-clockwise, in the figure), to move the second roll B2 toward the splicing device 7. This latter is still in the position of FIG. 8A, as can be seen in particular in FIG. 9A.

Figure 10A:
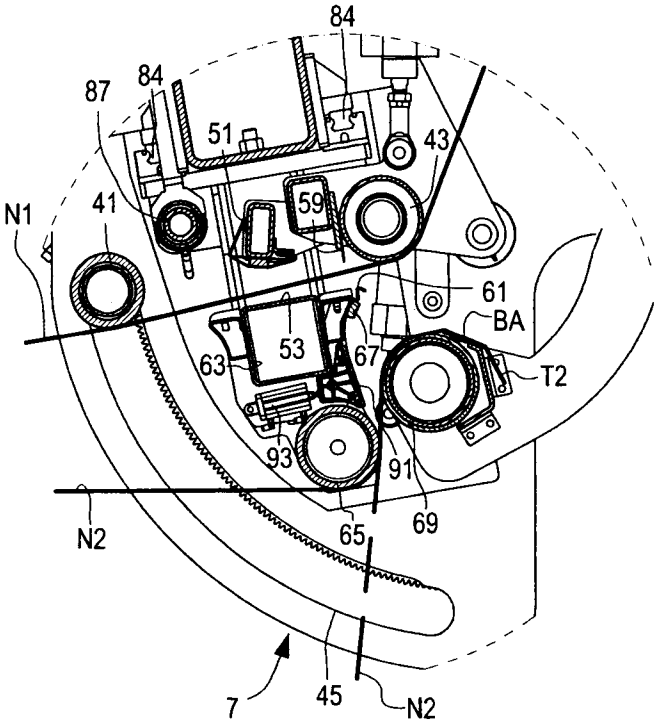
Figure 10:
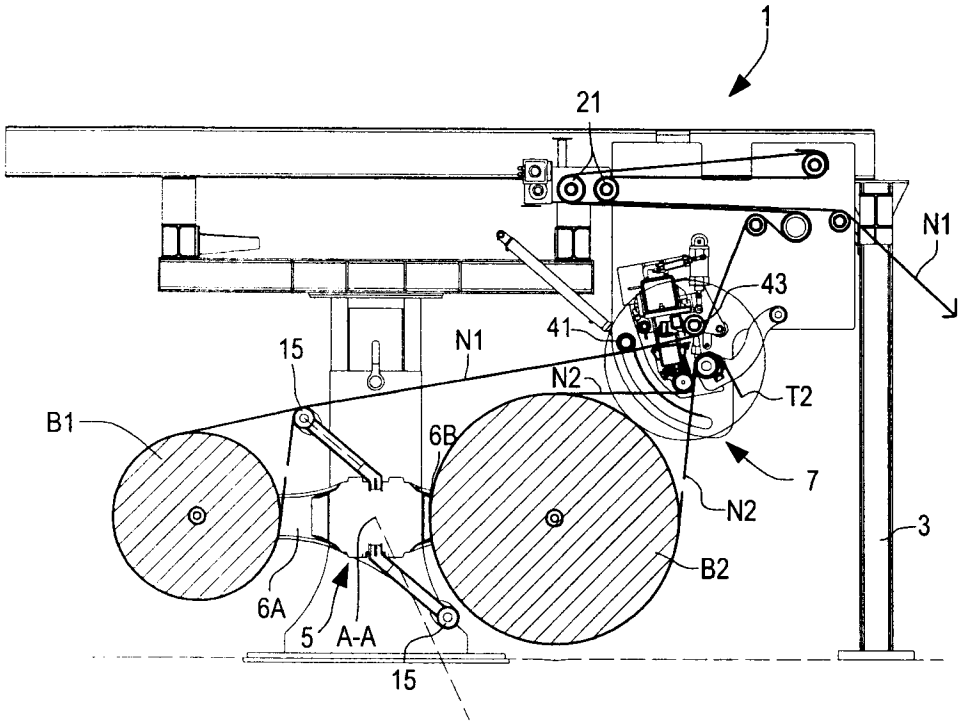

In the next step, shown in FIGS. 10 and 10A, an initial portion of a second web material N2 wound on the second roll B2 has been partially unwound from the roll B2 until the leading edge T2 of the second web material N2 is carried around the roller 69 forming the pinching member.

A presser 91, operated by a piston-cylinder actuator 93 and carried by the beam 63, can be used to press the web material N2 against the pinching member 69 preventing accidental removal of the web material N2 during the subsequent operations described below.

A strip of double-sided adhesive material BA can be applied to a portion of the web material N2 adjacent to the leading edge T2 (FIG. 10A) and the second web material N2 can be suitably trimmed in a position close to the double-sided adhesive strip BA.

In this step the web material N2 rests on the third guide roller 65.

Figure 11A:
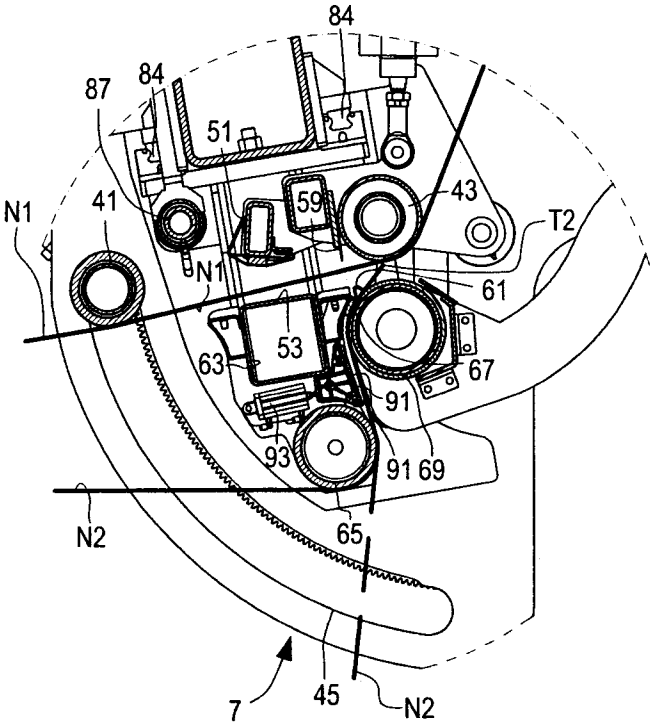
Figure 11:
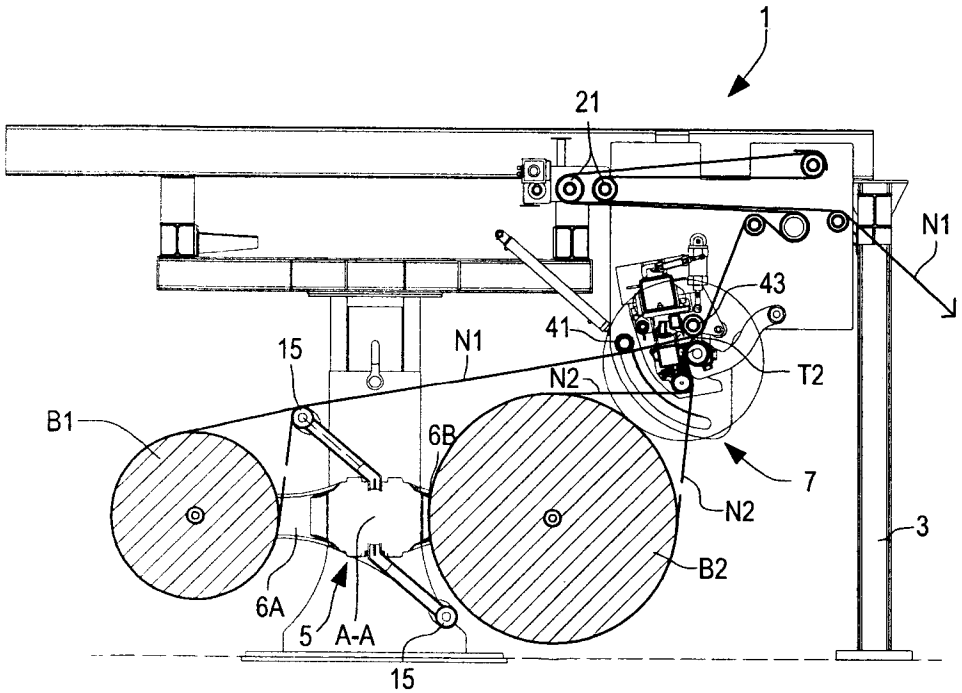

In the next FIGS. 11 and 11A the subsequent step of the operating cycle is shown, in which the pinching member 69 is raised rotating according to the arrow f69 until it presses against the anvil surface 67. In this way, the leading edge T2 of the web material N2 remains pinched between the anvil surface 67 and the pinching member 69. While in the preceding steps the beam 63 could be in the withdrawn position of FIG. 4, it must now be inserted into the load bearing structure 3, i.e., in the position of FIG. 3, to allow co-action of the anvil surface 67 and the pinching member 69.

In this step, the position of the rotating assembly 5 can remain the same as shown in FIGS. 10 and 10A.

Figure 12A:
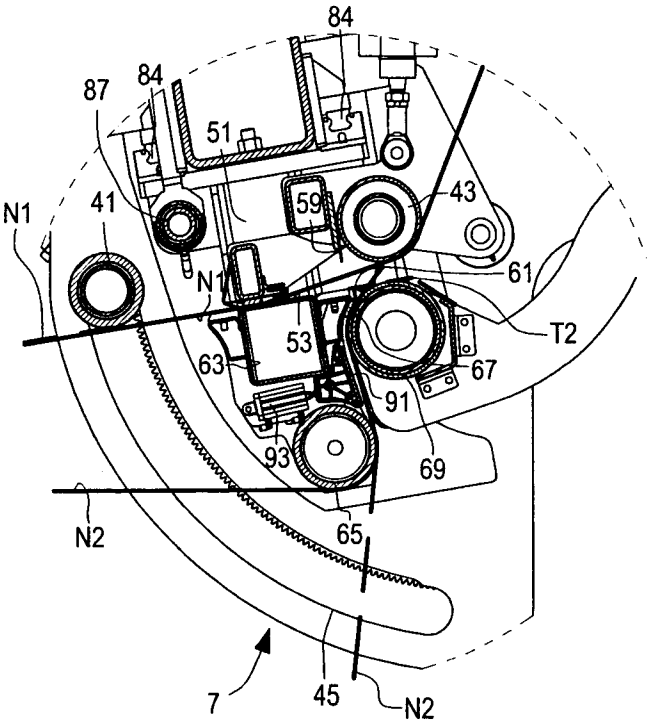
Figure 12:
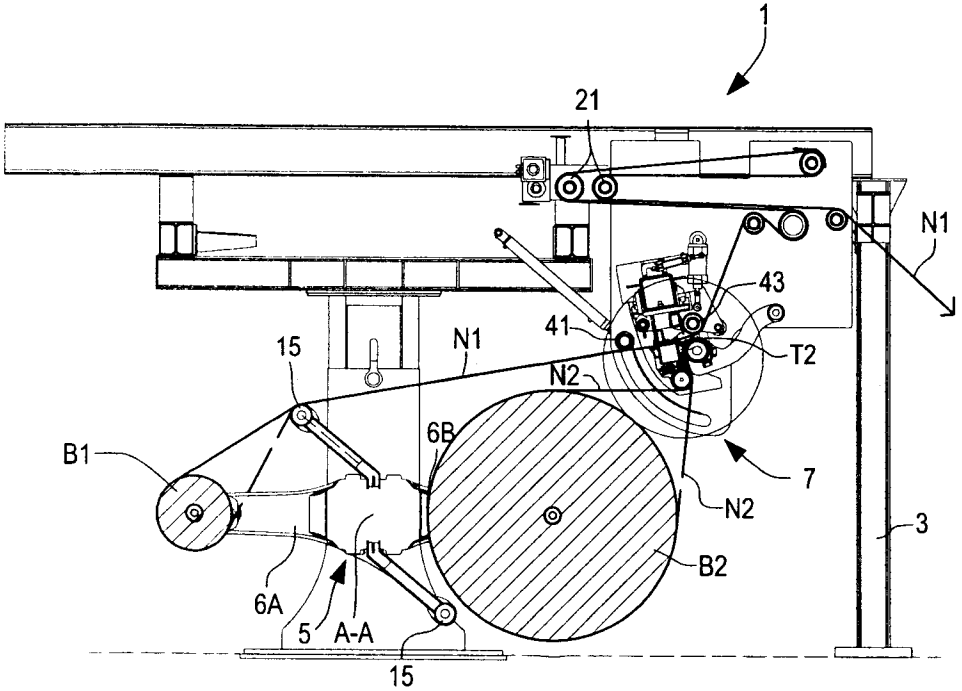
Figure 21A:
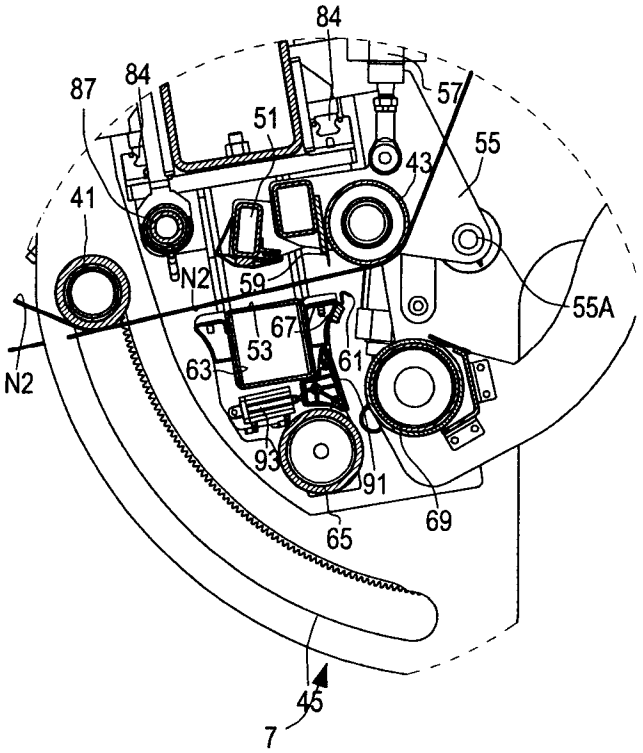
Figure 21:
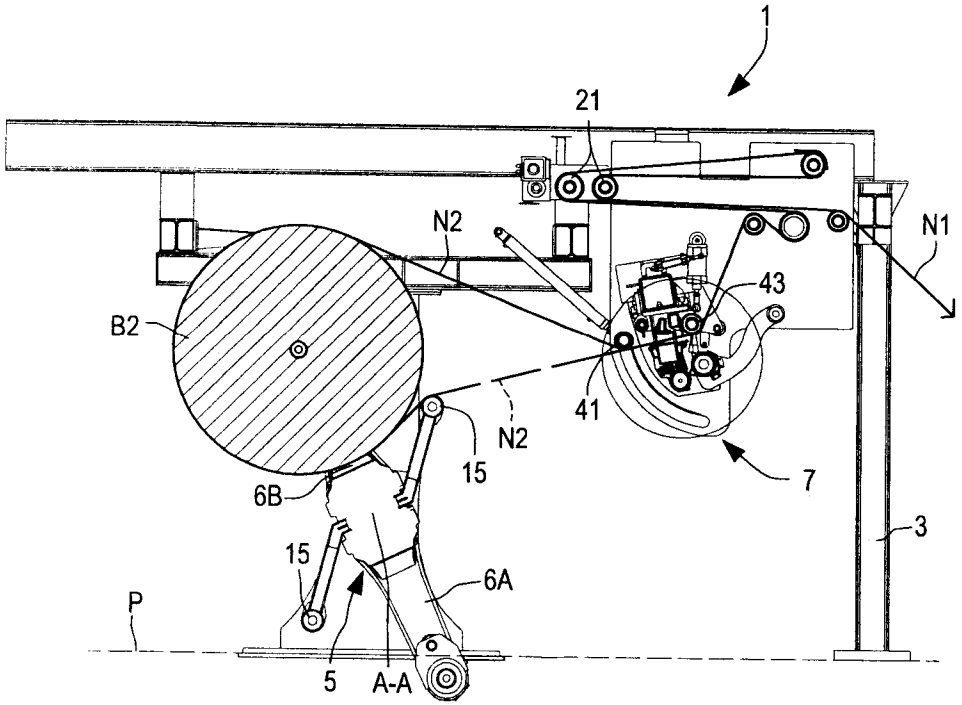

In FIG. 21 the roll B1 has almost expired and the web material N1 must be cut, forming a trailing edge that is spliced to the leading edge T2 of the second web material N2 standing by, coming from the second roll B2. In FIG. 12A it can be seen that, as preliminary step to the operation of splicing the two web materials N1 and N2, the braking member 51 has been lowered against the braking surface 53 integral with the beam 63. The web material N1 is thus braked until it stops, if necessary, at the braking member 51. Feed of the web material N1 from the unwinder 1 toward the line downstream (not shown) can be maintained at a substantially constant speed during this operating step. To this end, the supply of web material defined by the loops of web material guided about the rollers 21 is provided. These can translate from right to left (in FIG. 1) to accumulate a supply of web material N1 of suitable length. When the web material N is temporarily stopped by the braking member 51, the feed downstream of the unwinder is maintained using the web material supply formed in the upper area of the load bearing structure 3, translating the pair of rollers 21 from left to right, for example under the control of the gear motor 22.

Figure 13A:
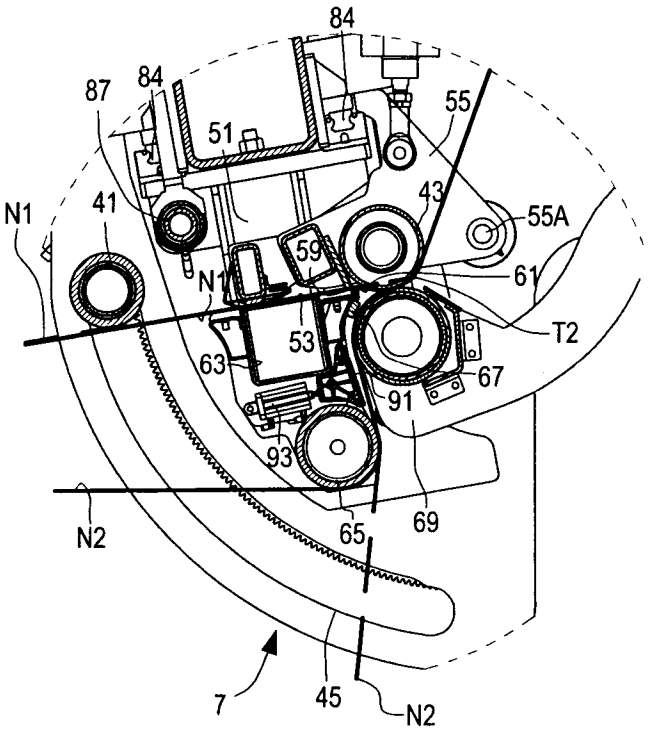
Figure 13:
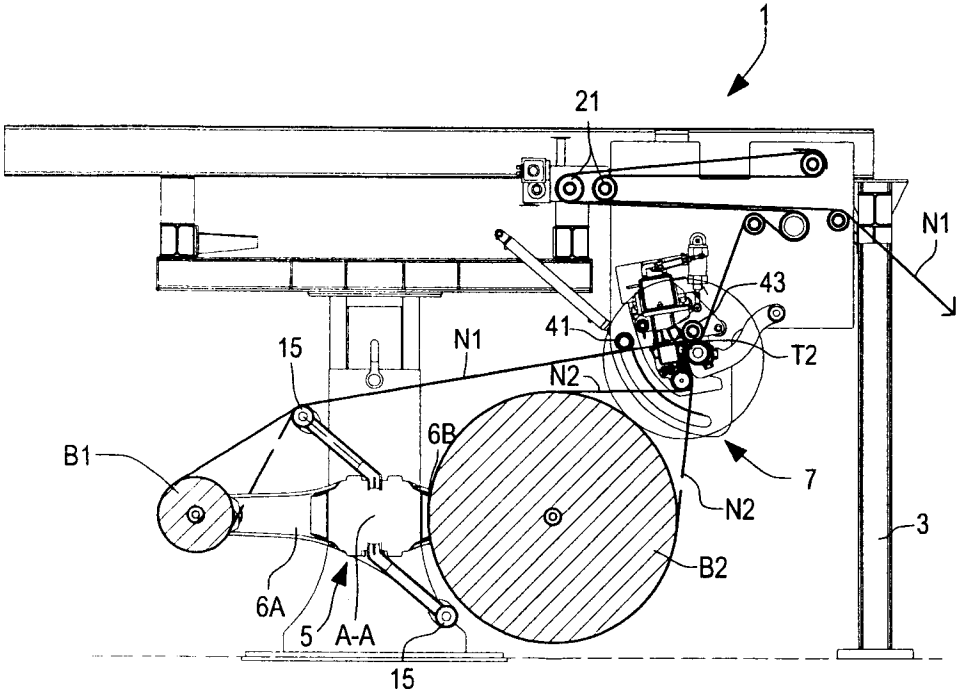

In the subsequent step illustrated the FIGS. 13 and 13A, it can be seen how the second guide roller 43 has been lowered by means of counter-clockwise pivoting (in the drawing) of the side members 55 around the fulcrum 55A. The movement of the second guide roller 43 is simultaneous to a lowering movement of the blade 59, which is also integral with the side members 55. The blade 59 thus enters inside the counter blade 61 causing cutting of the first web material N1 immediately upstream of the nip formed between the second guide roller 43 and the roller 69 forming the counter member. The downward movement of the guide roller 43 is such as to push the roller 69 downward, according to the arrow f69. As a result of the movement of the roller 69 away from the anvil surface 67, the initial portion of the second web material N2, adjacent to the leading edge T2, is released.

In this step the web material N1 and the web material N2 are pinched and retained in the nip between the guide roller 43 and the roller 69. Resuming or continuing the traction of the web material N1 by members downstream, not shown, the guide roller 43 continues to rotate, the movement being made possible by the cut made by the blade 59 and by the counter blade 61. The traction exerted on the first web material N1 that causes this latter to advance according to the arrow fN also causes the rotation of the roller 69. In this way the leading edge T2 of the second web material N2 starts to advance. Due to the pressure between the guide roller 43 and the roller 69, the strip of double-sided adhesive material BA causes mutual adhesion between the trailing edge of the web material N1, generated by the cut made by the blade 59 and by the counter blade 61, and the previously prepared leading edge T2 of the second web material N2.

Figure 14A:
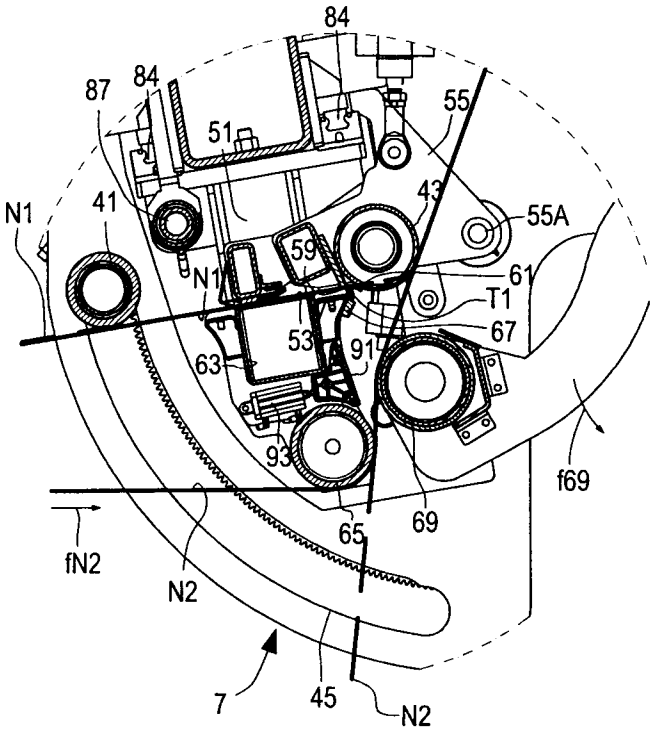
Figure 14:
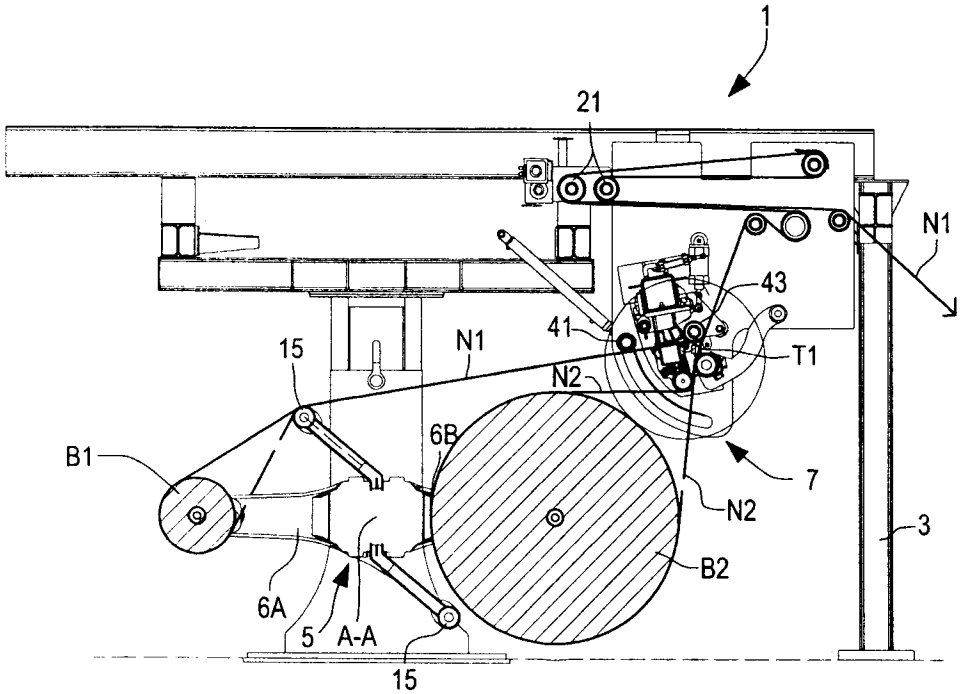

In FIGS. 14 and 14A the position of the rotating assembly 5 has remained substantially unchanged, while the position of the splicing device 7 has changed slightly as a result of the further lowering of the counter roller 69 according to the arrow f69. The leading edge T1 of the first web material N1 obtained by the cut made by the blade 59 and by the counter blade 61 is temporarily retained by the braking member 51 that presses on the braking surface 53.

The web material N2 coming from the second roll B2 starts to be fed to the members downstream of the unwinder 1, for example to a single facer or to a double facer. In this step the web material N2 is guided around the third guide roller 65 and around the roller 69, as well as around the second guide roller 43.

Figure 15A:
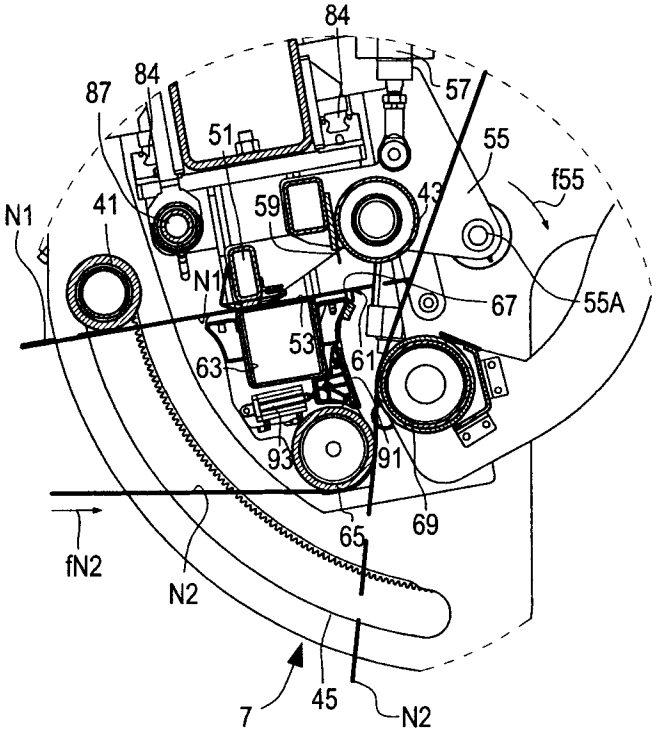
Figure 15:
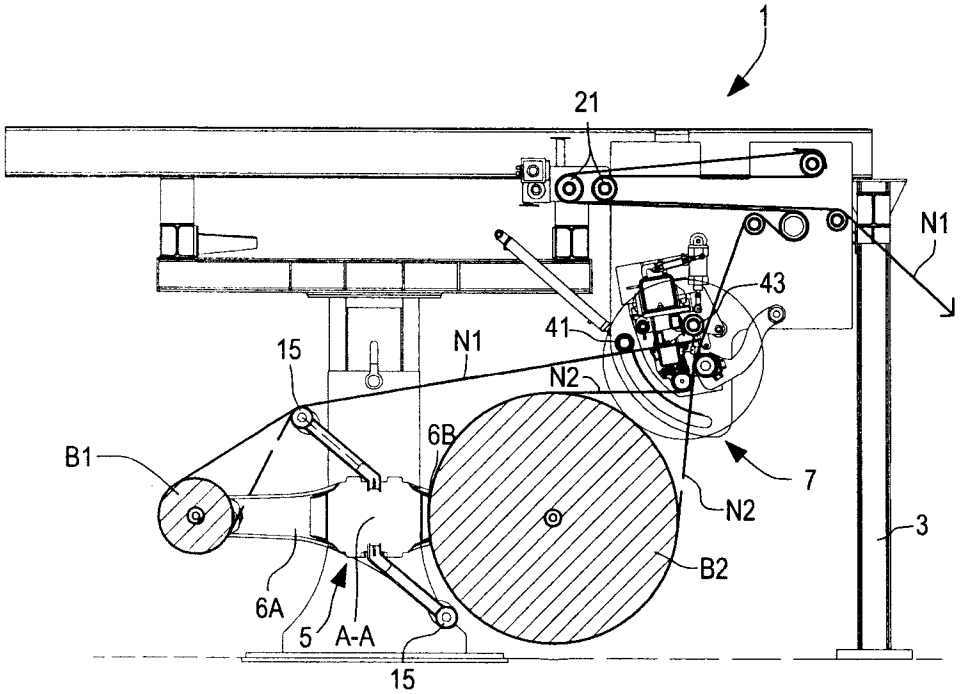

In the subsequent step illustrated in FIGS. 15 and 15A, the side members 55 have been raised by rotation according to the arrow f55 around the fulcrum 55A under the control of the piston-cylinder actuator 57, in this way moving the blade 59 away from the counter blade 61. In this step, the braking member 51 can still be pressed against the braking surface 53.

Figure 16A:
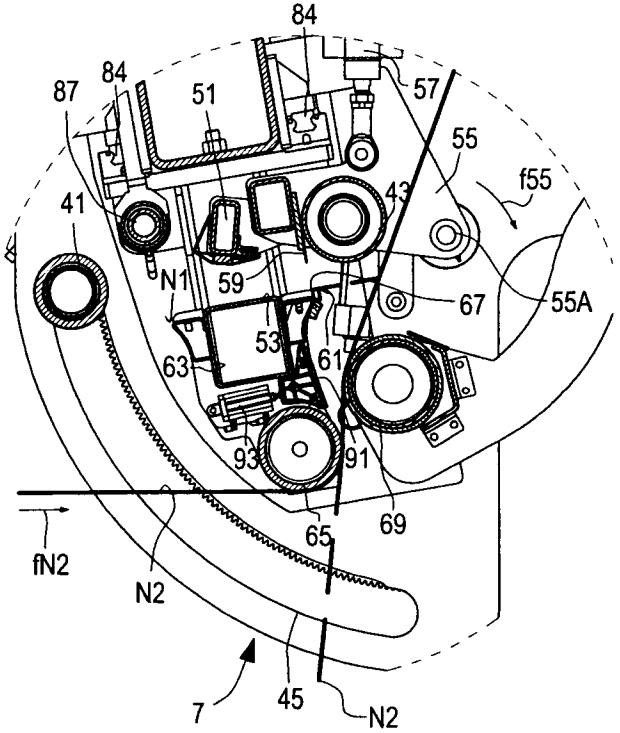
Figure 16:
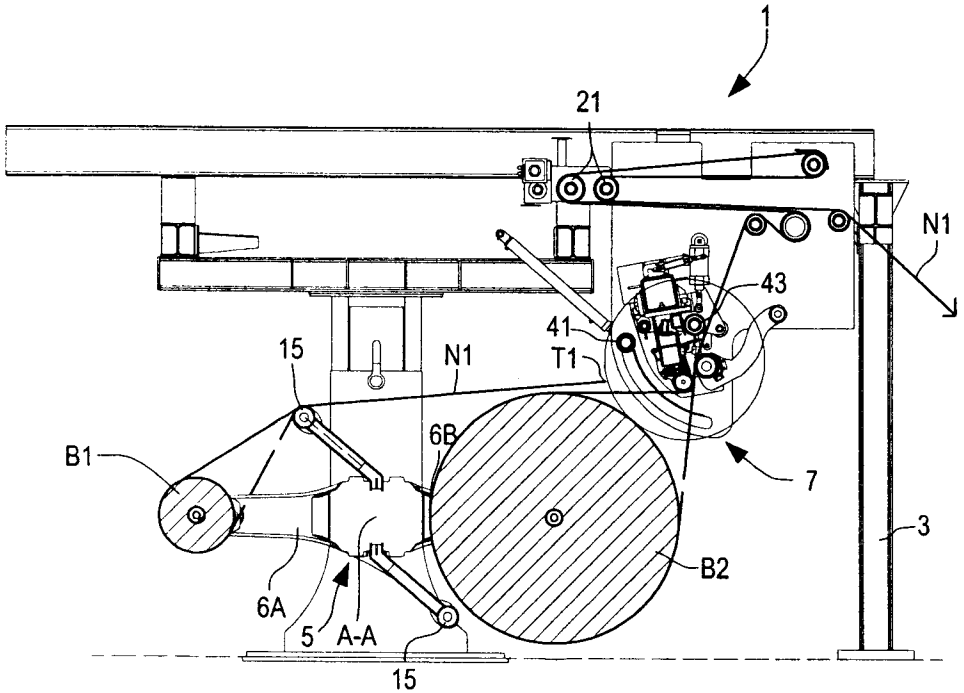

In the subsequent step illustrated in FIGS. 16 and 16A, the braking member 51 has also been raised, thus releasing the leading edge T1 of web material generated by the cut made by the blade 59 and by the counter blade 61. The rotating assembly 5 can still be in the position of the previous FIG. 15.

Figure 17A:
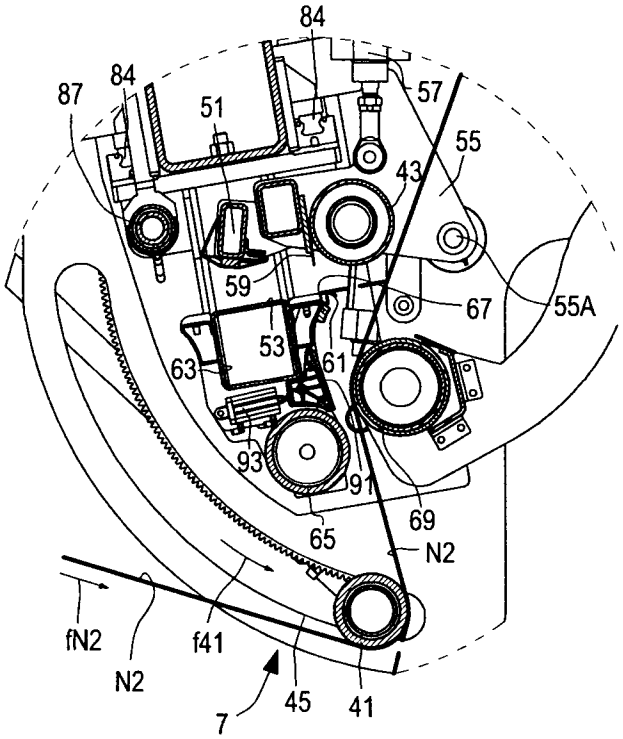
Figure 17:
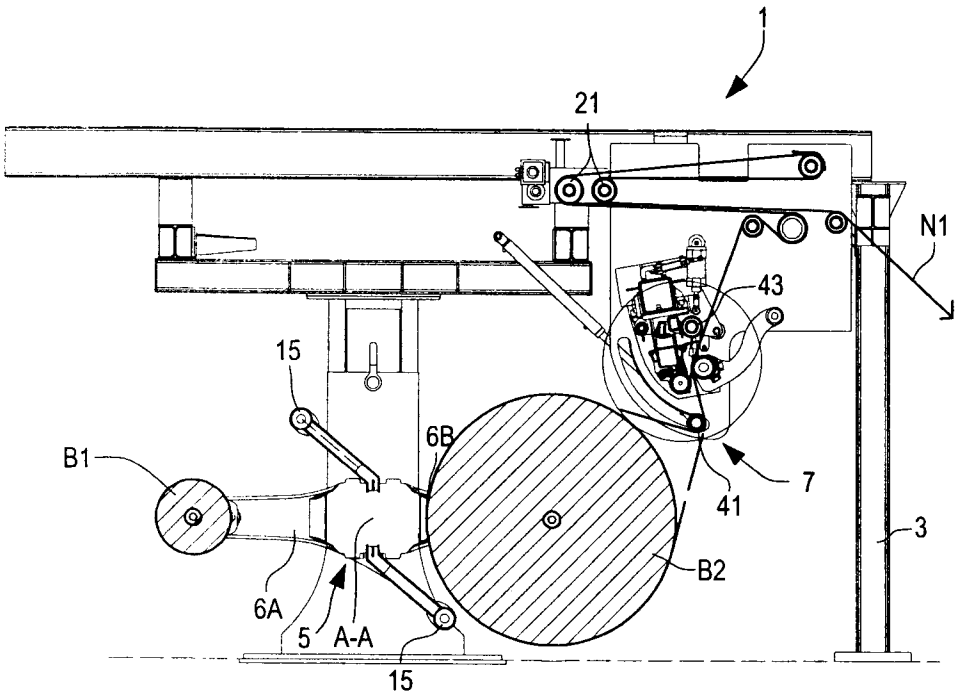

In the next FIGS. 17 and 17A the first guide roller 41 has been lowered according to the arrow f41 by means of the piston-cylinder actuator 49 until reaching the lowest position of the slots 45. In this way the path of the web material N2 is temporarily modified and moved away from the third guide roller 65 carried by the beam 63. As can be seen in particular in FIG. 17A, in this operating step the second web material N2 is thus guided around the first guide roller 41, around the counter roller 69 and from here reaches the roller 29 (FIG. 17), having also been detached from the second guide roller 43.

After reaching this position, the beam 63 with the third guide roller 65 and the counter blade 61 can be extracted by moving along the cross member 85, moving from the position of FIG. 3 to the position of FIG. 4.

Figure 18A:
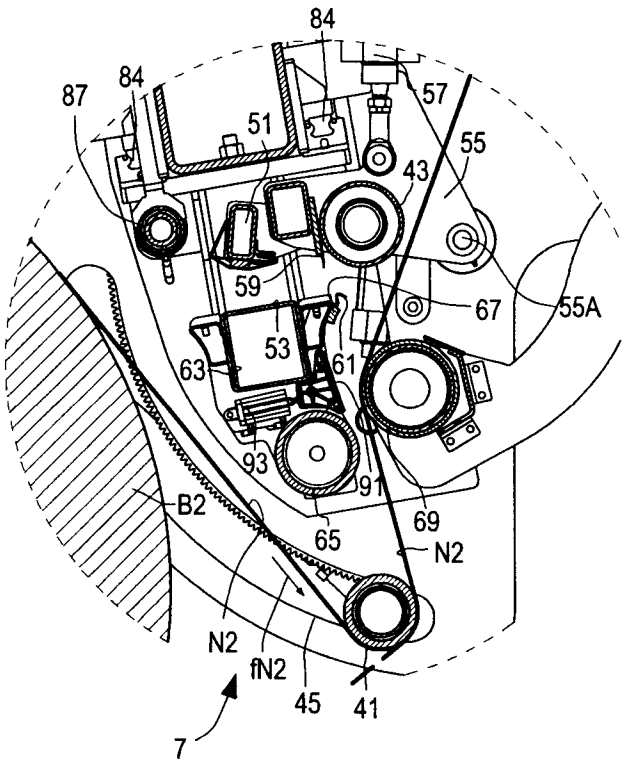
Figure 18:
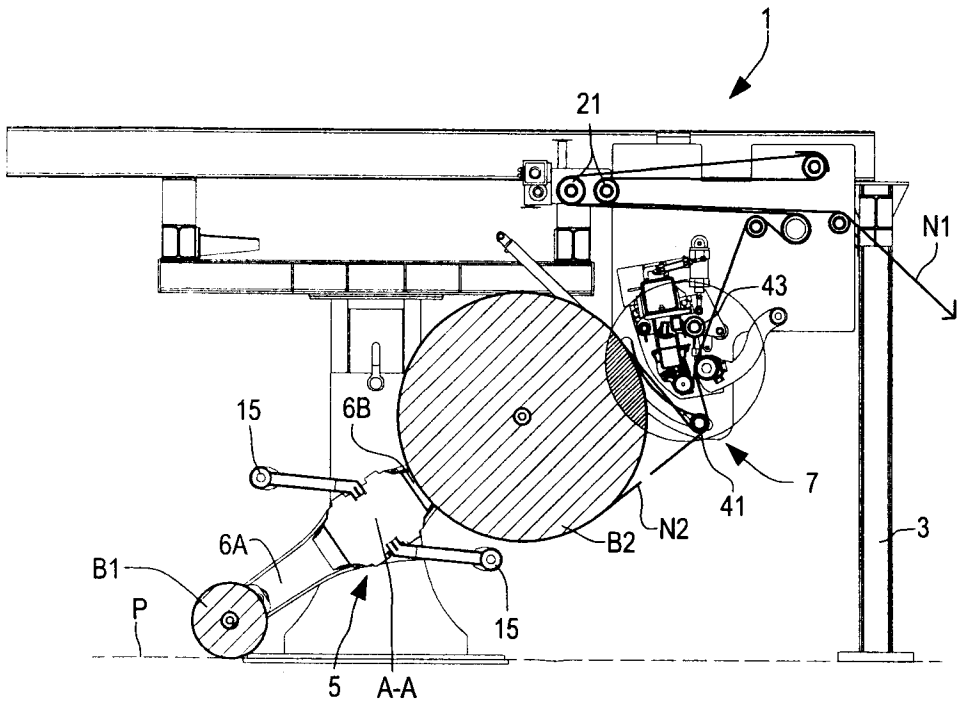

Before or after having carried out this extraction movement of the beam 63 the rotating assembly 5 can be rotated to transfer the roll B1 onto a floor P, or onto a conveyor flush with said floor, under said floor or slightly above said floor, simultaneously raising the roll B2 to the position illustrated in FIG. 18. FIG. 18A is substantially identical to FIG. 17A, but to indicate the fact that the beam 63 has been withdrawn, it (together with the members carried by it) is shown in dashed lines.

Figure 19A:
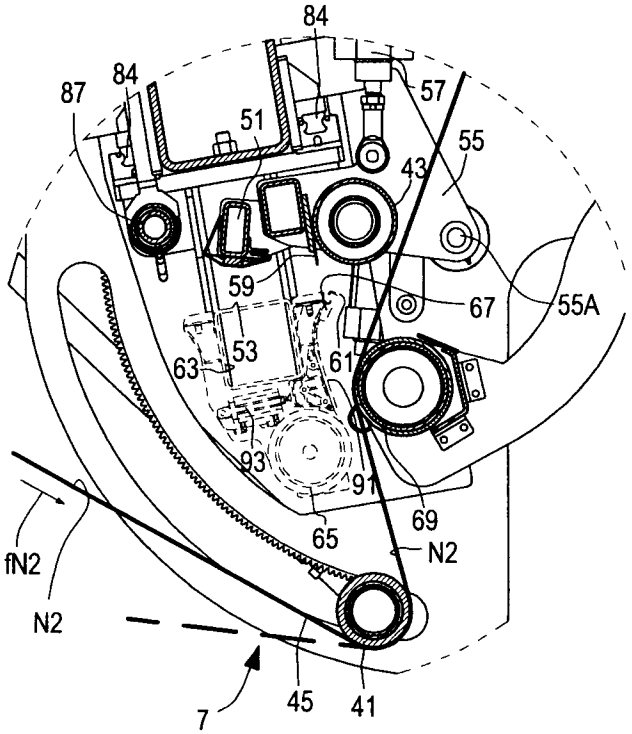
Figure 19:
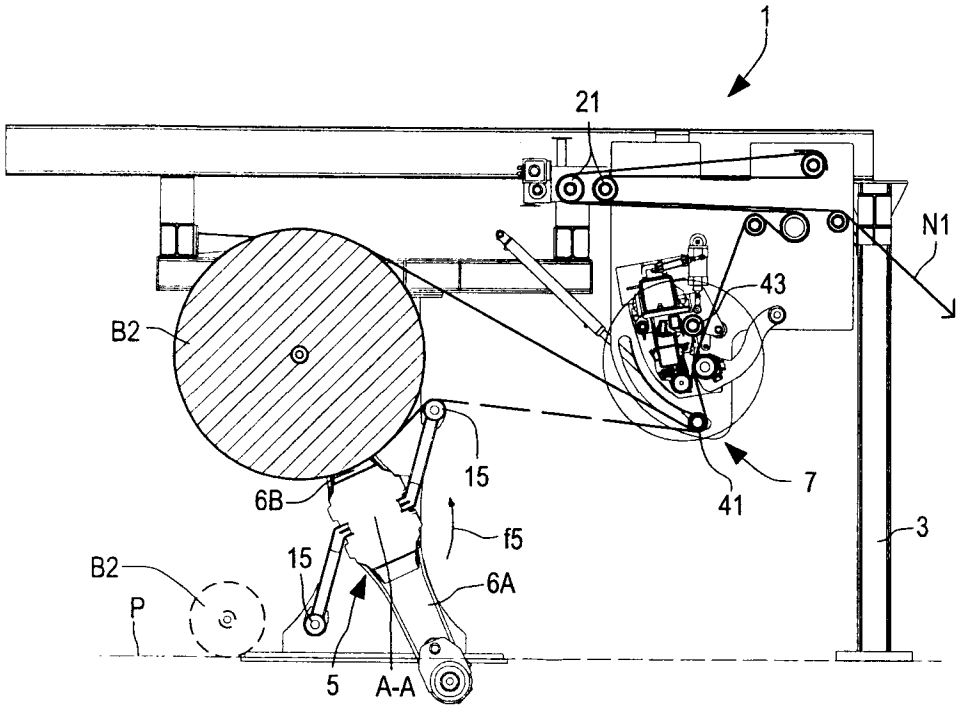

In FIG. 19 the tailstocks 9 of the arms 7A of the rotating assembly 5 have released the roll B2, which if necessary can be maintained standing by in the position depicted by the dashed line in FIG. 19, while the rotating assembly 5 continues its rotation (counter-clockwise according to the arrow f5 in the example illustrated) to carry the second roll B2 to the final position in which it will continue to unwind. In this step, the members of the splicing device 7 can remain in the same position as in the previous step, as can be seen by comparing FIGS. 19A and 18A. Also in FIG. 19A, to symbolize extraction of the beam 63, and of the members integral therewith, such as in particular the third guide roller 65, the counter blade 61 and the anvil surface 67, these elements are shown in dashed lines.

Figure 20A:
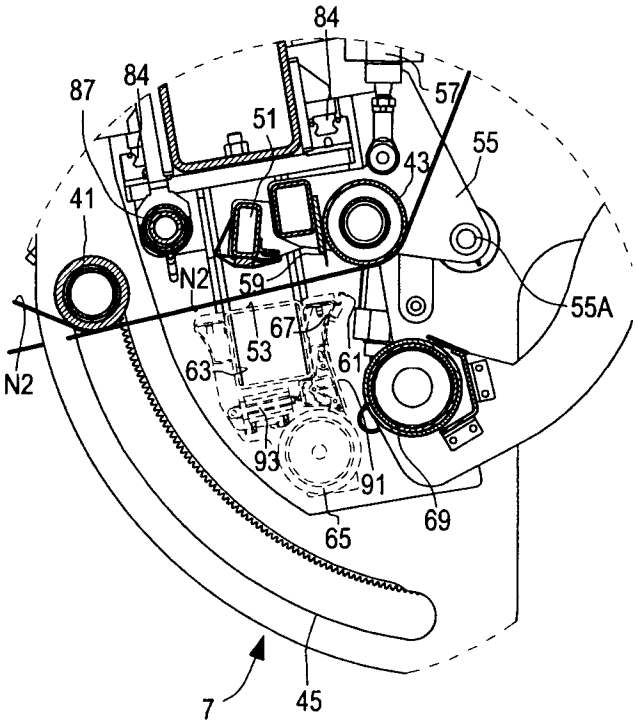
Figure 20:
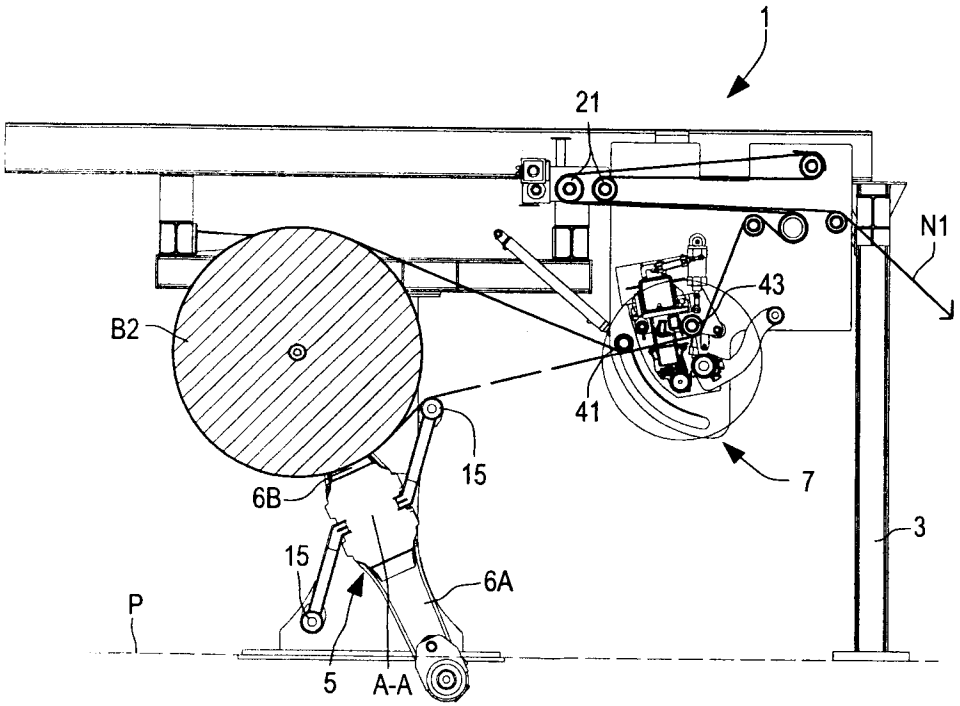

In the subsequent step shown in FIGS. 20 and 20A, with a movement according to the arrow f41, the first guide roller 41 is returned to the original position, so that the path of the second web material N2 is moved toward the blade 59. The rectilinear segment of web material N2 defined between the first guide roller 41 and the second guide roller 43 is thus positioned in the same way illustrated in FIGS. 6 and 6A, at a height greater than the height of the beam 63, temporarily extracted from the area through which the web material N2 passes.

Extraction of the beam 63 with the related members carried thereby in a direction transverse to the feed path of the web material N2 has allowed the upward movement of the first guide roller 41 and the consequent upward movement of the path of the web material N1 moving toward the blade 59.

IN FIG. 20A, the beam 63 and the members integral therewith are again shown in dashed lines, to symbolize that in this moment the beam 63 can be outside the footprint of the path of the web material N2.

In the subsequent FIGS. 21 and 21A, the beam 63 has been returned inside the load-bearing structure 3 (i.e., from the position of FIG. 4 to the position of FIG. 3), so that the counter blade 61 is arranged in front of the blade 59, with the path of the web material N2 extending from the guide roller 41 to the guide roller 43 and between the two cutting members, i.e., between the blade 59 and the counter blade 61. The splicing device 7 is thus once again in the position of FIG. 6A and can start a new operating cycle to perform splicing between the web material N2 and a third web material of a third roll that will be inserted into the unwinder device 1.

In the various operating steps of the unwinder described herein, the tension of the web material N1 or N2 can be controlled as follows. As mentioned previously, unwinding of the web material takes place by traction, for example by means of a pair of traction rollers, not shown. The brakes 11 exert a given braking torque on the roll B1 or B2 being unwound. The traction on the web material is set by applying a braking torque to the gear motor 22. In conditions of equilibrium, having established the total tensile force to be applied to the web material N1 or N2, the pair of guide rollers 21 and the gear motor 22 must remain in a specific position along the cross member 3B. The position is detected by means of a position transducer. If the position changes, i.e., if the pair of guide rollers 21 subjected to the traction of the cardboard and to the torque applied by the gear motor shifts, this means that there is no longer equilibrium between the force applied by the gear motor, the braking force of the brakes 11 on the roll and the traction exerted on the web material N1 or N2 by the traction rollers downstream (not shown). If, for example, the assembly comprising the gear motor 22 and the guide rollers moves in the direction of feed of the web material, i.e., toward the outlet of the unwinder 1 (i.e., to the right in FIG. 1), the braking torque exerted by the brakes 11 on the roll being unwound must be increased. On the contrary, if the pair of guide rollers 21 tends to move in the opposite direction with respect to the direction of delivery of the web material N1 or N2 from the unwinder (i.e., to the left in FIG. 1), then to return the system to a state of equilibrium the braking torque exerted by the brakes 11 must be reduced.

Ultimately, by acting on the gear motor 22 and on the brakes 11, by means of the position signal of the transducer or encoder that detects the position of the rollers 21, it is possible to maintain the traction of the web material N1 or N2 at a substantially constant and predetermined value.

Exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A method for splicing a trailing edge of a first web material to a leading edge of a second web material, comprising:

feeding the first web material along a feed path;

arranging a first cutting member and a second cutting member, respectively on a first side of the feed path and on a second side of the feed path, with one cutting member in front of the other cutting member;

arranging and retaining the leading edge of the second web material in proximity of the feed path;

cutting the first web material generating the trailing edge of the first web material and splicing the trailing edge of the first web material to the leading edge of the second web material;

moving one of said first cutting member and said second cutting member transverse to the feed path from an operating position, which is said first cutting member and said second cutting member positioned one in front of another, to an idle position, wherein in said idle position said first cutting member and said second cutting member are staggered transversely with respect to each other, wherein a respective one of said first cutting member or said second cutting member moves along a guide away from the feed path of the web material;

moving the second web material toward the other of said first cutting member and second cutting member;

returning the first cutting member and the second cutting member one in front of the other with the second web material arranged therebetween and feeding the second web material along the feed path between the first cutting member and the second cutting member.

2. The method of claim 1, further comprising moving the second web material away from the first cutting member and the second cutting member before moving the at least one of said first cutting member and the second cutting member moving transverse to the feed path.

* * * * *